US011012786B2

(12) United States Patent
King et al.

(10) Patent No.: US 11,012,786 B2
(45) Date of Patent: May 18, 2021

(54) ARMATURE-BASED ACOUSTIC RECEIVER HAVING IMPROVED OUTPUT AND METHOD

(71) Applicant: Knowles Electronics, LLC, Itasca, IL (US)

(72) Inventors: Charles King, Oak Park, IL (US); Andrew Unruh, San Jose, CA (US); Daniel Warren, Geneva, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 16/342,383

(22) PCT Filed: Oct. 17, 2017

(86) PCT No.: PCT/US2017/056873
§ 371 (c)(1),
(2) Date: Apr. 16, 2019

(87) PCT Pub. No.: WO2018/075442
PCT Pub. Date: Apr. 26, 2018

(65) Prior Publication Data

US 2019/0238994 A1 Aug. 1, 2019

Related U.S. Application Data

(60) Provisional application No. 62/409,341, filed on Oct. 17, 2016.

(51) Int. Cl.
*H01R 11/00* (2006.01)
*H04R 11/04* (2006.01)
(Continued)

(52) U.S. Cl.
CPC ..... *H04R 11/04* (2013.01); *H04R 1/04* (2013.01); *H04R 3/04* (2013.01); *H04R 11/02* (2013.01)

(58) Field of Classification Search
CPC ..... H04R 11/02; H04R 11/04; H04R 3/04; H04R 1/04
See application file for complete search history.

(56) References Cited

U.S. PATENT DOCUMENTS 3,935,398 A 1/1976 Carlson et al.
5,690,093 A 11/1997 Schrank et al.
(Continued)

FOREIGN PATENT DOCUMENTS

CN 204350285 U 5/2015
CN 205596313 U 9/2016
(Continued)

OTHER PUBLICATIONS

European Patent Office; International Search Report and Written Opinion; International Application No. PCT/US2018/041921; dated Feb. 15, 2019.
(Continued)

*Primary Examiner* — Matthew A Eason
(74) *Attorney, Agent, or Firm* — Faegre Drinker Biddle & Reath LLP

(57) ABSTRACT

A pre-distorted electrical excitation signal is generated for an acoustic transducer having an armature and a non-linear transfer characteristic by applying an electrical input signal (x) representative of a desired acoustic output to a computable non-linear function that is a function of the electrical input signal (x). When applied to an input of the transducer, the pre-distorted electrical excitation signal results in an improved acoustic output signal.

20 Claims, 15 Drawing Sheets

(51) Int. Cl.

| | |
|---|---|
| ***H04R 11/02*** | (2006.01) |
| ***H04R 3/04*** | (2006.01) |
| ***H04R 1/04*** | (2006.01) |

(56) References Cited

U.S. PATENT DOCUMENTS

| | | | | |
|---|---|---|---|---|
| 6,757,403 | B2 | 6/2004 | Urushibata et al. | |
| 2006/0140436 | A1 | 6/2006 | de Moel et al. | |
| 2006/0239488 | A1 | 10/2006 | Geschiere et al. | |
| 2010/0054509 | A1* | 3/2010 | Thompson | H04R 11/02 381/312 |
| 2012/0008814 | A1 | 1/2012 | Alwicker et al. | |
| 2012/0286865 | A1 | 11/2012 | Chandrasekaran | |
| 2013/0272564 | A1* | 10/2013 | Miller | H04R 3/00 381/412 |
| 2014/0369548 | A1 | 12/2014 | Manley et al. | |
| 2015/0036831 | A1* | 2/2015 | Klippel | H04R 11/00 381/55 |
| 2015/0249889 | A1* | 9/2015 | Iyer | H04R 3/08 381/98 |
| 2016/0227328 | A1 | 8/2016 | Van Halteren et al. | |
| 2020/0154212 | A1 | 5/2020 | Albahri et al. | |
| 2020/0213788 | A1 | 7/2020 | Albahri | |

FOREIGN PATENT DOCUMENTS

| | | | |
|---|---|---|---|
| CN | 107135449 | A | 9/2017 |
| CN | 107222818 | A | 9/2017 |
| CN | 206775740 | U | 12/2017 |
| CN | 206879090 | U | 1/2018 |
| CN | 207354540 | U | 5/2018 |
| GB | 859830 | A | 1/1961 |
| WO | 2015/057519 | A1 | 4/2015 |
| WO | 2016/058637 | A1 | 4/2016 |
| WO | 2019/014510 | A2 | 1/2019 |

OTHER PUBLICATIONS

European Patent Office; International Search Report and Written Opinion; International Application No. PCT/US2017/056873; dated Mar. 19, 2018.

* cited by examiner

AMPLIFIER AND RECEIVER

108

ARMATURE-BASED ACOUSTIC RECEIVER HAVING IMPROVED OUTPUT AND METHOD

TECHNICAL FIELD

This disclosure relates generally to acoustic transducers having a non-linear transfer characteristic and more specifically to armature-based receivers having improved performance and corresponding methods.

BACKGROUND

Balanced armature receivers that convert an electrical input signal to an acoustic output characterized by a varying sound pressure level (SPL) are known generally. Such receivers generally comprise a motor having a coil to which an electrical excitation signal is applied. The coil is disposed about a portion of an armature (also known as a reed), a movable portion of which is disposed in equipoise between magnets, which are typically retained by a yoke. Application of the excitation or input signal to the receiver coil modulates the magnetic field, causing deflection of the reed between the magnets. The deflecting reed is linked to a movable portion of a diaphragm (known as a paddle) disposed within a partially enclosed receiver housing, wherein movement of the paddle forces air through a sound outlet of the housing.

The objects, features, and advantages of the present disclosure will be more apparent to those of ordinary skill in the art upon consideration of the following Detailed Description with reference to the accompanying drawings.

Those of ordinary skill in the art will appreciate that elements in the figures are illustrated for simplicity and clarity. It will be further appreciated that certain actions or steps may be described or depicted in a particular order of occurrence while those of ordinary skill in the art will understand that such specificity with respect to sequence is not actually required unless a particular order is specifically indicated. It will also be understood that the terms and expressions used herein have the ordinary meaning as is accorded to such terms and expressions with respect to their corresponding respective fields of inquiry and study except where specific meanings have otherwise been set forth herein.

DETAILED DESCRIPTION

Armature-based receivers (also referred to herein as a "receiver") generally have a non-linear transfer characteristic dependent on various physical and operating characteristics of the transducer. Such characteristics include, for example, changing permeability of the armature due to a changing magnetic flux, among others. The output SPL of a receiver depends generally on the amplitude and frequency of the input signal. Receiver non-linearity tends to limit the undistorted output SPL, since higher SPL tends to aggravate distortion. Maximum output SPL is often specified for a particular level of distortion. The result is that the acoustic output of the receiver may not be an accurate reproduction of the desired acoustic output signal.

Figure 1:
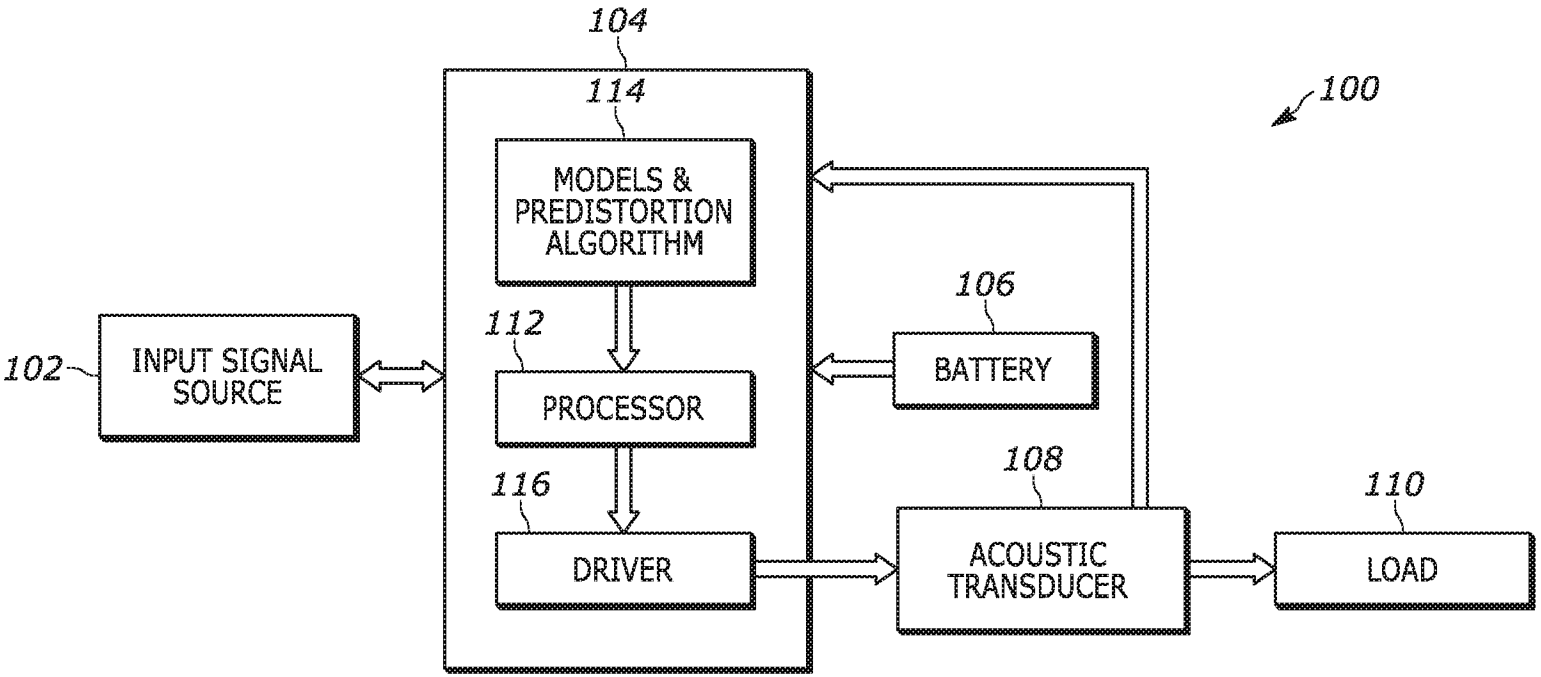
FIG. 1 is a block diagram of a system for generating a pre-distorted excitation signal for input to an armature-based receiver.

The present disclosure pertains to improving performance of an armature-based receiver by driving the receiver with a pre-distorted electrical excitation signal. FIG. 1 is a block diagram of a feed-forward system 100 that uses a computable non-linear function representing the behavior of the receiver to generate the pre-distorted electrical excitation signal. When applied to the input of an armature-based receiver, the pre-distorted electrical excitation signal improves performance of the receiver at least in part by compensating for non-linearity of the receiver including non-linearity attributable to a changing permeability of the armature. Such improved performance may result in increased SPL for a specified distortion level or in increased linearity for a specified SPL. These and other aspects and benefits are discussed further below.

Armature-based receivers refer to a class of acoustic transducers having an armature (also known as a reed) with a movable portion that deflects relative to one or more magnets in response to application of an excitation signal to a coil of the receiver. Such receivers may be balanced or unbalanced. An armature-based receiver is ideally balanced when it has no magnetic flux, or at least negligible flux, in or through the armature when the armature is in a steady-state (stationary or rest) position (i.e., in the absence of an excitation signal applied to the coil). A receiver is unbalanced when there is magnetic flux in or through a stationary armature in its nominal rest position. An armature-based receiver with only one magnet is inherently unbalanced. Generally an unbalanced receiver will have decreased output SPL for a specified level of distortion compared to a balanced receiver. This imbalance can be detected by measuring a second harmonic of the distortion of an output signal produced in response to high amplitude input or drive signals. An armature-based receiver may be unbalanced due to deviation from manufacturing tolerances or for some other reason. Also, a balanced armature-based receiver may become unbalanced upon changing the rest position of the reed between the magnets. Such repositioning of the reed rest position may occur as a result of an impact from dropping the receiver or from some other shock imparted thereto.

One source of non-linearity in armature-based receivers is attributable to changing permeability of soft magnetic components of the receiver in response to an excitation signal applied to the receiver coil. Soft magnetic components include but are not limited to the armature, the yoke or other soft magnetic parts of the receiver. Nickel-Iron (Ni—Fe) is a soft magnetic component commonly used in armature-based receivers, although other soft magnetic materials may also be used. The relationship between an external magnetizing field H induced by a current in the receiver coil and the magnetic flux density B in the armature is nonlinear, particularly when driven by excitation signals having relatively high amplitude. At some point, when the magnetizing field H is strong enough, the magnetic field H cannot increase the magnetization of the armature further and the armature is said to be fully saturated when the permeability of material is equal to 1. In some armature-based receivers, this nonlinear relationship between the magnetizing field H and the magnetic flux density B is a primary source of nonlinearity, particularly at high output SPLs. However armature-based receivers exhibit non-linear behavior even where the receiver operates over a relatively linear portion of the magnetization curve.

Another source of nonlinearity in armature based receivers is attributable to the force/deflection characteristics of the reed and diaphragm. Ideally, for small displacements, there is a linear relationship between force and deflection as specified by Hooke's law. In reality this relationship is non-linear in many receivers. Air flow in armature-based receivers may also be a source of non-linearity. For example, in order to compensate for changes in barometric pressure, a small vent is often provided in the diaphragm paddle to equalize air pressure in front and back air chambers of the receiver. However air flowing through this vent during operation encounters a varying resistance to that flow which causes distortion. There may be other sources of distortion associated with air flow in or through other parts of the receiver or the load, including air flow in or through the acoustic output port, any tubing connected to the output port, the load (e.g., a human ear), load coupling parts, among other components of the receiver. The non-linear transfer characteristic of other acoustic transducers may result from other sources that are specific to the architecture of such transducers.

During the manufacture of armature-based receivers one or more permanent magnets are magnetized by exposure to a strong external polarizing magnetic field. The magnitude of the remnant magnetic field induced in the magnets is a primary factor in the sensitivity of the receiver. Increasing this remnant field (or magnetization) of the magnets generally increases sensitivity or efficiency of the receiver but also increases distortion. An over-magnetized receiver may have a reduced output SPL for a specified distortion level compared to a receiver that is not over-magnetized. This reduced output SPL tends to increase with increasing levels of magnetization. Thus the magnetization level of a receiver requires a tradeoff between sensitivity and distortion for most use cases.

Some armature-based receivers and particularly the magnets or other permanently magnetized portions thereof are over-charged or over-magnetized, or magnetized to a greater level than best practice would normally dictate. A receiver is strongly over-magnetized when the magnetic force is stronger than a mechanical restoring force of the movable portion of the armature (i.e., the restoring force of the reed, but not the restoring force of other parts of the receiver like the diaphragm). In a strongly over-magnetized receiver, in the absence of loading by other components (e.g., the diaphragm), the reed will tend to stick to one magnet or the other if the reed is offset from its equilibrium position. Over-magnetization may be intentional or it may result from a deviation from manufacturing tolerances, or lack thereof, when charging or magnetizing the magnets or other permanently magnetized parts of the receiver.

Figure 2:
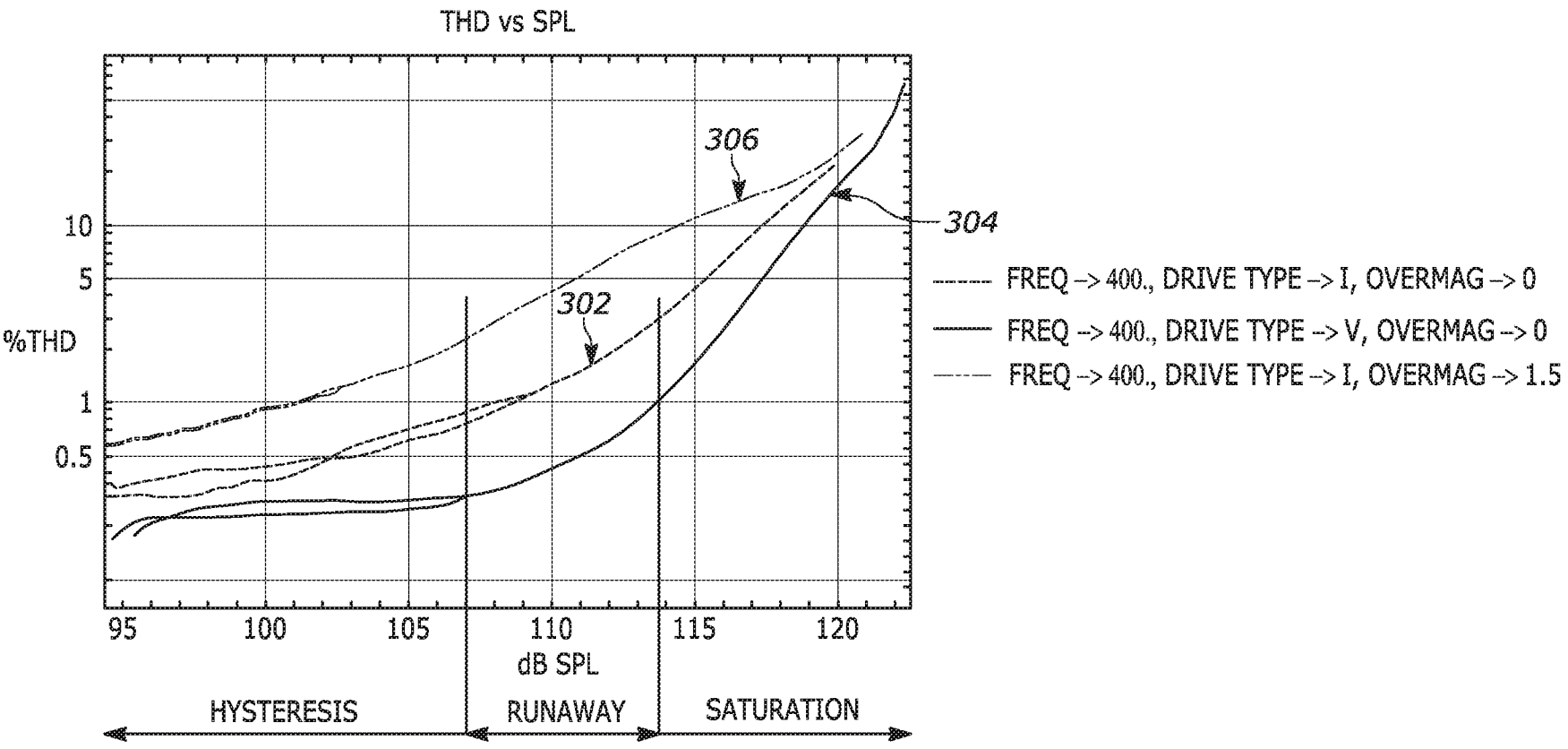
FIG. 2 is a graph of total harmonic distortion (THD) versus SPL for different magnetizations and for different types of input or excitation signals without pre-distortion.
Figure 3B:
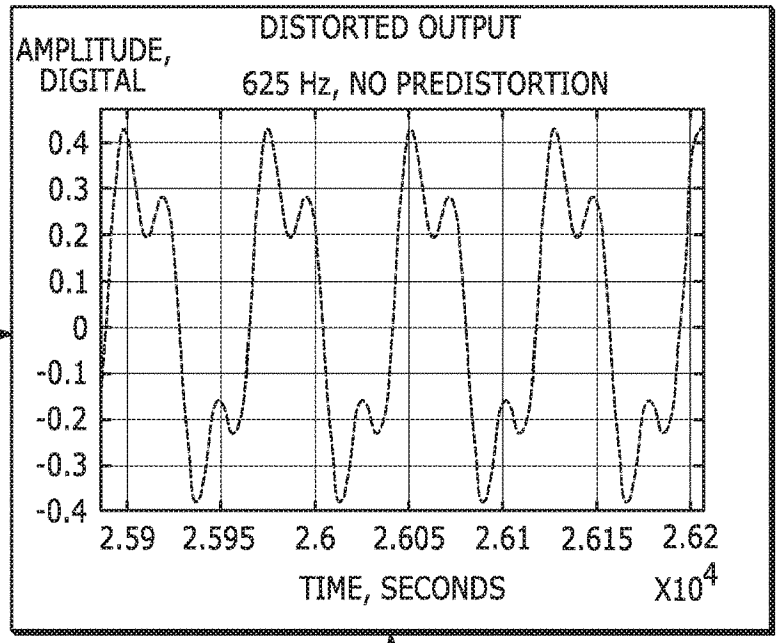
FIGS. 3A-3D are comparative illustrations of a receiver output in response to input signals with and without pre-distortion.
Figure 3A:
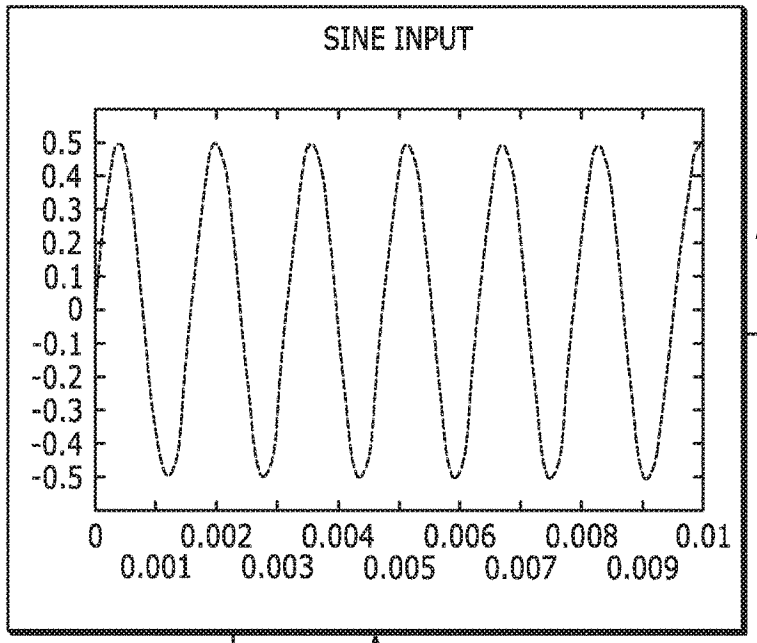
Figures 3C, 3D:
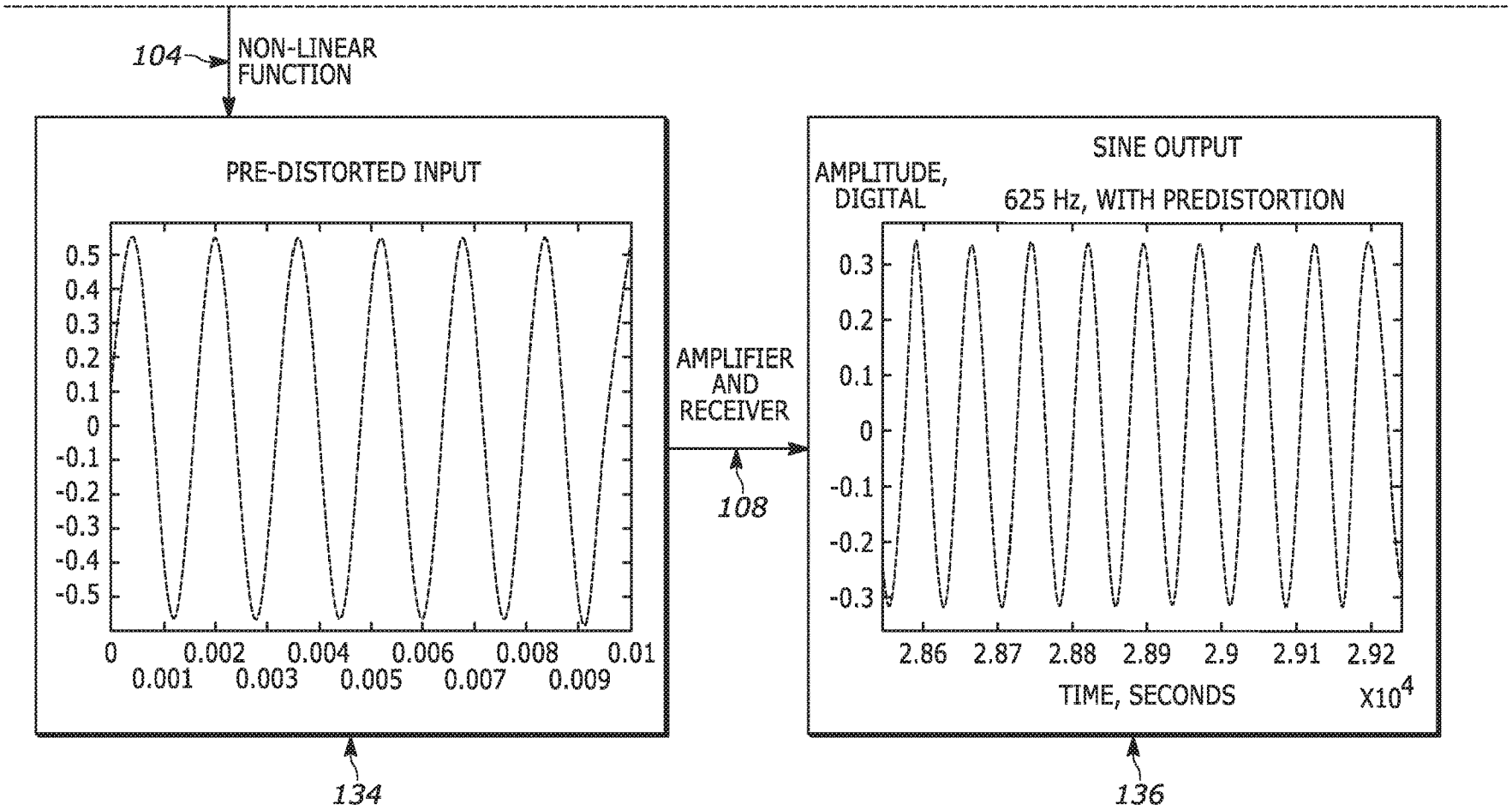

FIG. 2 is a graph of total harmonic distortion (THD) versus output SPL for different types of drive signals and for different magnetic charge levels in an armature-based receiver driven by an electrical excitation signal without pre-distortion. While 400 Hz data is shown, other frequencies or ranges may be used alternatively. Plot 302 represents THD versus SPL for a receiver without over-magnetization where the receiver coil is driven by a current signal having a frequency of 400 Hz. Plot 304 represents THD versus SPL for a receiver without over-magnetization where the coil is driven by a voltage signal having a frequency of 400 Hz. Plot 306 represents THD versus SPL for a receiver where the coil is driven by a current signal having a frequency of 400 Hz and where the armature is over-magnetized such that receiver sensitivity (in Pascal/Volt) is increased by 1.5 dB. FIG. 2 illustrates that, for a given level of distortion, e.g., five percent (5%), the output SPL for an over-magnetized receiver is less than the SPL of a receiver without over-magnetization. FIG. 2 also illustrates that a current driven receiver has lower SPL than a voltage driven receiver at the specified distortion level in the absence of pre-distortion.

In FIG. 2, the output distortion is dominated by different characteristics of the receiver over different operating regions depending on coil current, which is related to output SPL. Generally higher coil current creates more flux in the reed, producing more reed deflection and corresponding movement of the diaphragm resulting in a higher acoustic output SPL. The operating regions are described as Hysteresis, Runaway, and Saturation in FIG. 2. These regions are primarily related to the amount of flux in the reed. In the saturation region, the permeability in the armature is low and is changing rapidly, thus the output distortion increases rapidly. To maintain the output distortion at or below a specified maximum, for example, five percent (5%), the coil current must be maintained at or below a certain level. However, reducing the coil current may result in a significant reduction in SPL. In the runaway region, the permeability is higher than in the saturation region and the attraction between the reed and the magnet generally increases as the deflecting reed moves closer to the magnet. Thus there is a tendency for the reed to deflect more as the space between the reed and magnet decreases. If the magnetic force is stronger than the total mechanical restoring force of the receiver (i.e., the restoring force of the reed, the diaphragm and other parts of the receiver), the magnetic force will deflect the reed toward the magnet and the reed may ultimately stick to the magnet. As shown, runaway is a dominant source of nonlinearity at mid-drive levels. At lower coil current levels, non-linearity due to hysteresis is predominant.

Output distortion of an acoustic transducer or receiver is reduced using a feed-forward algorithm that applies a pre-distorted electrical excitation signal to an input of the receiver. The feed-forward system can be open or closed. In an open system, a pre-distorted electrical excitation signal is applied to an input of the receiver without adapting the pre-distortion to changes in a characteristic of the receiver.

In a closed system, information indicative of a change in a characteristic of the receiver is used to adaptively update the computable non-linear function used to pre-distort the input signal. The feed-forward system uses an inverse model to generate the pre-distorted electrical excitation signal. The inverse model can be created through testing or by numerically inverting a forward model. The inverse model may be efficiently implemented using a non-linear polynomial, among other computable non-linear functions. These and other aspects of the disclosure are described further herein.

The pre-distorted electrical excitation signal is an output of a computable non-linear function of an electrical input signal (x) representative of a desired acoustic output. For armature-based receivers, the pre-distorted electrical excitation signal compensates for non-linearity attributable to mechanical and magnetic hysteresis, runaway and saturation among other sources.

In FIG. 1, the system includes an input signal source 102, an input signal pre-distortion circuit 104, a battery or power supply 106, an armature-based receiver 108 with a non-linear transfer characteristic, and an acoustical load 110. The load is representative of the user's ear and any interconnecting structure like acoustic tubing and coupling devices as well as leakage and venting. The acoustic load may be different depending on the particular type of receiver and the application or implementation. A driver circuit 116 provides the pre-distorted electrical excitation signal to the receiver. The input signal source provides an electrical input signal representative of a desired acoustic output signal. The input signal could be an analog signal or a digital signal. In embodiments where pre-distortion is performed by a digital processor, an analog input signal will be converted to a digital signal. The pre-distortion circuit 104 includes an algorithm that generates a pre-distorted electrical excitation signal for the electrical input signal as discussed herein. The algorithm may be implemented at least partially as computer instructions executed by a processor 112 or by one or more separate equivalent circuits. The algorithm includes a partial or complete inverse model that describes how an input signal must be modified to achieve a desired output for a particular receiver or for a particular class of receivers. The inverse model can be based on empirical data obtained from an actual receiver or from a model of a receiver or of a class of receivers. Alternatively, the inverse model can be based on a forward model that predicts the receiver output for a given input to the receiver. The forward model can be inverted through computational techniques to directly create the inverse model. The algorithm and any model of the receiver may be stored in a memory device 114 associated with the receiver. The driver circuit 116 may be collocated with the processor and memory device on a common integrated circuit as shown, or the driver circuit may be a separate or discrete entity from the pre-distortion circuit.

In FIG. 1, the input signal source 102 may be any acoustic signal source. In one embodiment, the input signal is obtained from a microphone, for example, a condenser microphone like an electret or a microelectromechanical systems (MEMS) microphone, or from a piezo-electric device or some other acoustic transduction device. The microphone may be part of a hearing aid, a headset, a wearable device, or some other system in which the acoustic receiver is integrated or with which the receiver communicates. Alternatively, the input signal may be obtained from a media player or from some other source, which may be internal or external to the system. The battery 106 may be required in implementations where portability is desired, for example, where the receiver constitutes part of a consumer wearable product, like a hearing aid, a wireless headset and an ear piece, among other products. The pre-distortion circuit 104 including the driver circuit 116 may be integrated with the acoustic receiver 108 or with some other part of a system in which the receiver is integrated. Some implementation examples are discussed below.

FIGS. 3A-3D illustrate the output of an acoustic receiver in response to a sinusoidal electrical input signal without pre-distortion compared to the receiver output in response to the sinusoidal electrical input signal subject to pre-distortion using a computable non-linear function 104 as described further herein. Application of the sinusoidal electrical input signal 132 to the input of the acoustic receiver 108 results in a distorted acoustic signal 138 at the output of the receiver. Pre-distorting the sinusoidal electrical input signal 132 using the non-linear function 104 and applying the pre-distorted electrical input signal 134 to the receiver 108 produces a relatively undistorted acoustic signal 136 at the receiver output. While the output signal 136 may have some distortion, it will have less distortion than the output signal 138.

Figure 4:
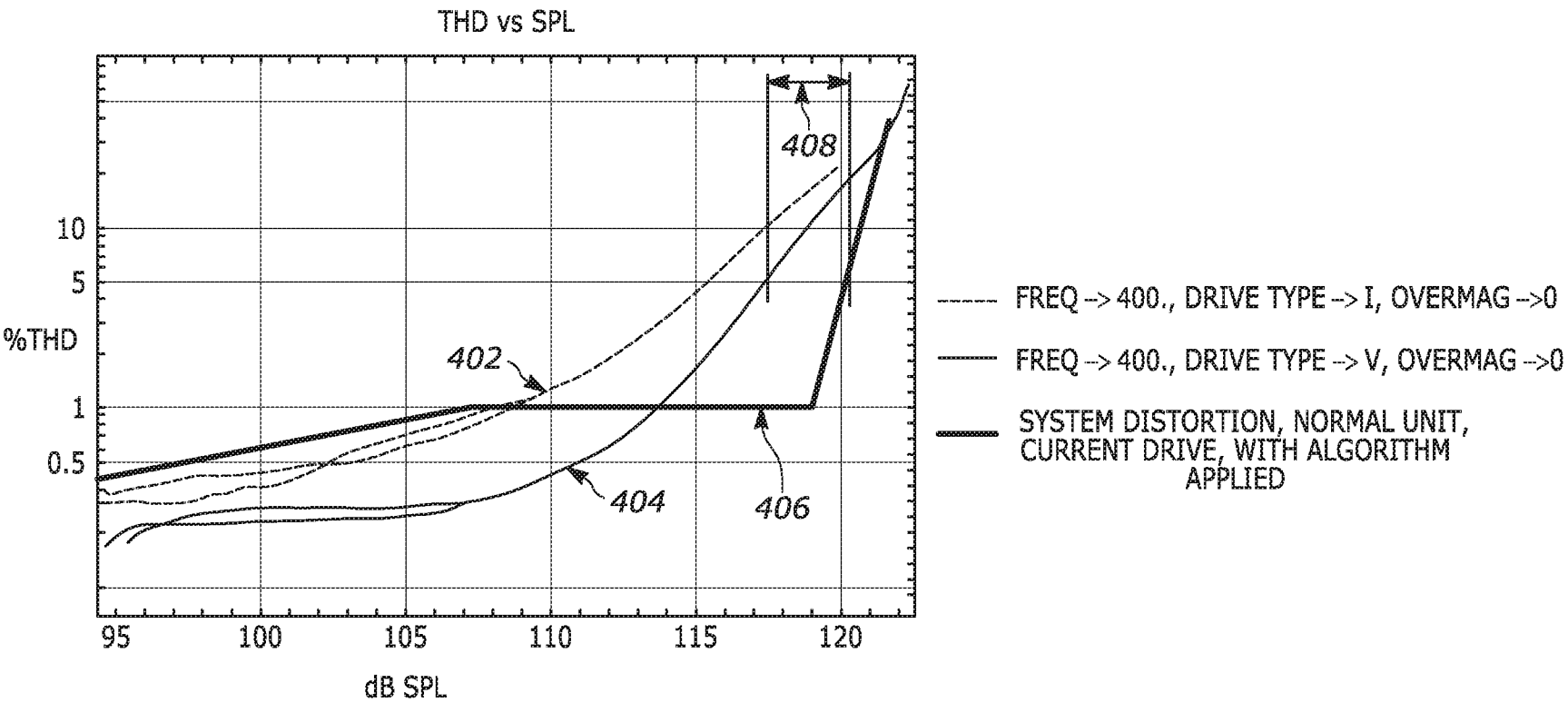
FIG. 4 is a graph of THD versus SPL for receivers driven by different types of amplifiers with and without pre-distortion.

FIG. 4 illustrates various graphs of THD versus SPL for armature-based receivers, driven by electrical excitation signals, with and without pre-distortion. While 400 Hz data is shown, other frequencies or ranges may be used alternatively. Plot 402 represents THD versus SPL for an input signal having a frequency of 400 Hz applied to the receiver by a current amplifier where the input signal is not pre-distorted. Plot 404 represents THD versus SPL for an input signal having a frequency of 400 Hz applied to the receiver by a constant voltage amplifier where the input signal is not pre-distorted. Voltage amplifiers have relatively low output impedance with respect to armature-based receivers and current amplifiers have relatively high output impedance. Many devices, particularly portable electronic devices, exist in an intermediate state were the output impedance is on the same order as the impedance of the armature receiver. Plot 406 represents THD versus SPL for a pre-distorted input signal having a frequency of 400 Hz applied to the receiver by a constant current amplifier. FIG. 4 illustrates that for five percent (5%) THD, the SPL of plot 406 is increased by approximately 3 dB (identified as improved SPL 408) relative to the SPL of plot 404. Plot 406 shows that the receiver begins to saturate at higher input current levels (corresponding to higher output SPL) when the excitation signal is pre-distorted.

Figure 5:
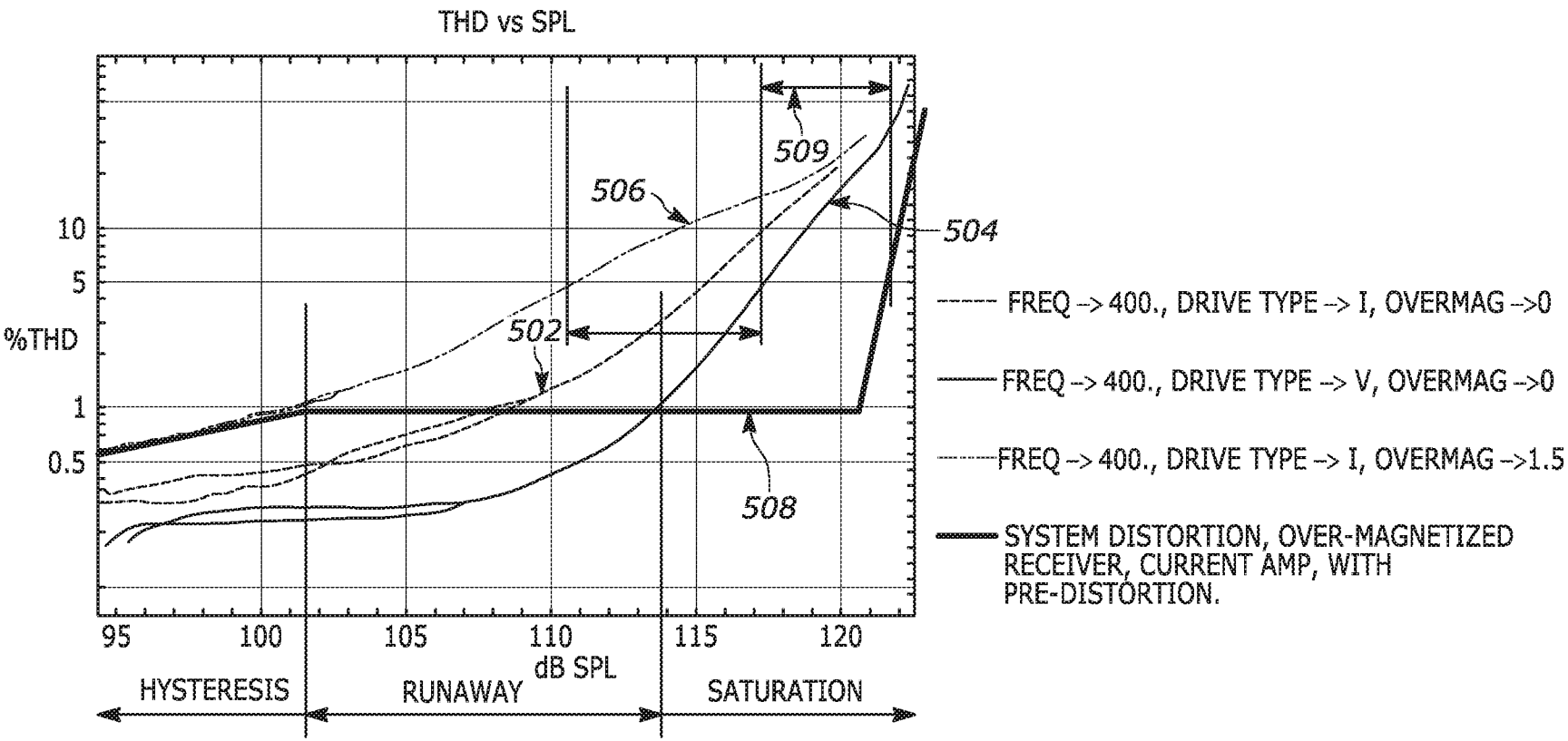
FIG. 5 is a graph of THD versus SPL for receivers driven by different types of amplifiers with and without pre-distortion, including an over-magnetized receiver.

FIG. 5 illustrates various graphs of THD versus SPL for armature-based receivers with and without over-magnetization, driven by excitation signals with and without pre-distortion. While 400 Hz data is shown, other frequencies or ranges may be used alternatively. Plot 502 represents THD versus SPL for an input signal with a frequency of 400 Hz applied to the receiver by a constant current amplifier where the input signal is not pre-distorted and the receiver is not over-magnetized. Plot 504 represents THD versus SPL for an input signal with a frequency of 400 Hz applied to the receiver by a constant voltage amplifier where the electrical input signal is not pre-distorted and the receiver is not over-magnetized. Plot 506 represents THD versus SPL for an input signal without pre-distortion and having a frequency of 400 Hz applied to a receiver by a constant current amplifier, wherein sensitivity of the receiver is increased by 1.5 dB due to over-magnetization. Plot 508 represents THD versus SPL for a pre-distorted input signal having a frequency of 400 Hz applied to a receiver by a constant current amplifier, wherein sensitivity is increased by 1.5 dB due to over-magnetization. FIG. 5 illustrates that for five percent (5%) THD, the output SPL of plot 508 is increased by approximately 4 dB (identified as improved SPL 509) relative to the output SPL of plot 504. Plot 508 shows that the receiver begins to saturate at higher input current levels (corresponding to higher output SPL) when the excitation signal is pre-distorted despite the receiver being over-magnetized and despite being driven by a relatively constant current amplifier. This result is contrary to what is suggested by plots 502 and 506, which show a tendency for the output SPL to decrease when the receiver is driven by a constant current amplifier or when the receiver is over-magnetized, respectively.

Figure 6:
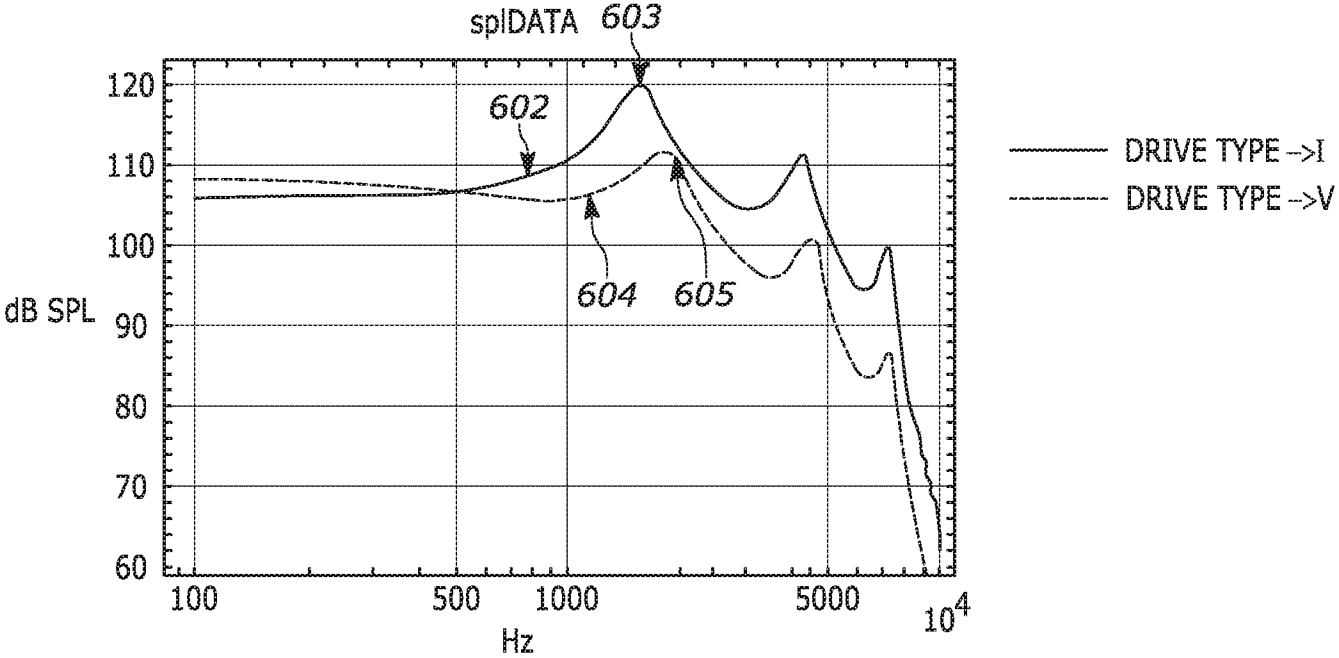
FIG. 6 illustrates the frequency response of a receiver driven by different types of amplifiers.

FIG. 6 is a graph of output SPL versus frequency for an armature-based receiver for different types of drive signals. Plot 602 represents SPL versus frequency when the receiver is driven by a constant current source and plot 604 represents SPL versus frequency when the receiver is driven by a constant voltage source. The frequency response of the output 602 produced by the current source is generally more flat than the output 604 produced by the voltage source. At frequencies greater than about 500 Hz, FIG. 6 also illustrates that SPL is greater when the receiver is driven by the constant current source compared to when the receiver is driven by the constant voltage source. A first peak 603 and 605 indicates the frequency of the primary mechanical resonance of the respective plots 602 and 604. The other peaks represent other resonant frequencies of the receiver. The frequency of the primary mechanical resonance of the receiver depends on the mechanical stiffness of the system (e.g., the reed and suspension in an armature-based receiver) and on the moving mass of the mechanical system (e.g., reed, diaphragm, drive rod and suspension in an armature-based receiver). More specifically, the resonance frequency is proportional to the square root of a ratio of the mechanical stiffness k to moving mass m (sqrt(k/m)). In FIG. 6, the primary mechanical resonance of plot 602 is about 1700 Hz and the primary mechanical resonance of plot 604 is about 1900 Hz. Generally, a higher negative stiffness tends to lower the resonant frequency of the receiver, whereas an increased mechanical restoring force (i.e., positive stiffness) of the receiver tends to increase the resonant frequency of the system. Negative stiffness refers to the tendency of the magnetic force to counteract the mechanical restoring force of the reed.

Generally, a pre-distorted electrical excitation signal is generated by applying an electrical input signal (x) representative of a desired acoustic output to a computable non-linear function before the pre-distorted electrical excitation signal is applied to the acoustic receiver. The function modifies the input signal to provide a desired acoustic output at an acoustic output port of the receiver. A computable function is one for which there exists an algorithm that can produce an output of the function for a given an input within the domain of the function. The computable non-linear function could be embodied as a continuous function or as a piecewise linear function. A piece-wise linear function could be based on a look-up table where linear interpolations are used to identify values between data points in the table. Other curve fitting schemes may be used to generate linear or nonlinear functions that approximate a data set representing an inverse model suitable for distorting an input signal.

In one embodiment, the computable non-linear function is any function that can be approximated by a rational polynomial. Such functions include polynomials, hyperbolic and inverse hyperbolic functions, logarithmic and inverse logarithmic functions, among other function forms. These and other functions may be approximated by a summation of a limited set of terms having odd or even exponents (e.g., a truncated Taylor series) as is known generally. Rational polynomial and polynomial functions are readily and efficiently implemented by a digital processor. In other embodiments, other computable non-linear functions may be used. Such other functions may have negative exponents, exponents that are less than unity, or non-integer exponents, a set of orthogonal functions, an inverse sigmoid form or some other form. Thus many suitable functional forms will include at least one term that is proportional to $x^n$ where n is not equal to unity or the value of one (1). The form of the computable non-linear function and parameters thereof (e.g., number of terms, order, coefficients, etc.) required for adequate compensation will depend in part on the particular receiver, the particular application or use case, and on the desired output.

In one embodiment, the non-linear function is a polynomial having the following general form:

$$y(x)=k_1x+k_2x^2+k_3x^3+\ldots+k_nx^n \quad \text{Eq. (1)}$$

In Equation (1), the variable x is an electrical input signal representative of the desired acoustic signal and the function parameters are coefficients. The electrical input signal could originate from a microphone associated with a hearing-aid, from an audio source like a media player, or from any other source. The coefficients $k_n$ represent constants for the $n^{th}$ order terms in the series. The signal resulting from the summation of terms is non-linear and the terms and polynomial coefficients are selected to compensate for non-linearity of the acoustic receiver as discussed below. Odd ordered terms generally compensate for symmetric non-linearity and even ordered terms generally compensate for asymmetric non-linearity. Thus the polynomial of Equation (1) compensates for both symmetric and asymmetric non-linearity. In armature-based receivers symmetric non-linearity may be attributable to magnetic saturation of the receiver, air noise, receiver suspension, among other characteristics, and asymmetric non-linearity may be attributable to reed imbalance, receiver suspension, among other receiver characteristics.

The polynomial of Equation (1) compensates most effectively for non-linearity at frequencies below the primary mechanical resonance of the receiver where the frequency response is substantially flat (as shown in FIG. 6). Also, below the primary resonance, the sensitivity of the receiver with respect to input current is similar. In other words, the coefficients in Equation (1) are effective in reducing distortion on frequencies below the primary mechanical resonance of the receiver. For frequencies above the primary resonance, the coefficients in the polynomial of Equation (1) are more strongly frequency-dependent. A generalization of Equation (1) is to replace the coefficients in Equation (1) with frequency-dependent transfer functions (e.g., time-domain filters) as follows:

$$y=(h_1(x)+(h_2(x))^2+(h_3(x))^3+\ldots+(h_n(x))^n \quad \text{Eq. (2)}$$

In Equation (2), $h_n(x)$ is a time-domain filter wherein the output of the filter $h_1(x)$ is added to the square of the output of filter $h_2(x)$ and to the cube of filter $h_3(x)$, and so on where the filter powers are taken on a per sample basis. It will be appreciated that a special case of Equation 2 is where one or more of the time-domain filters are identical. In such a case, efficiencies can be realized by processing the input signal through identical filters only once and then simply exponentiating those outputs to different degrees before adding. Equation (2) extends the applicability of polynomial-based compensation to higher frequencies.

Equation (2) could be implemented using an Autoregressive Moving-Average (ARMA) filter. An ARMA filter is a digital filter that uses present and past values of the input signal and past values of the output signal to compute a current output signal. The same input is applied to each filter, but the filter outputs are different, due at least in part to the order of various terms. A typical ARMA filter implementation is as follows:

$$y[n]=b_0x[n]+b_1x[n-1]+b_2x[n-2]+a_1y[n-1]+a_2y[n-2] \quad \text{Eq. (3)}$$

In Equation (3), x[n] is the filter input, y[n] is the filter output, and the constants $a_n$ and $b_n$ are filter parameters, where n=0, 1, 2 . . . .

For many applications, polynomials with frequency independent terms like Equation (1) will provide reasonably good compensation for receiver non-linearity, since much of the energy in the input signal is below the primary mechanical resonance of the receiver. In one particular implementation, the non-linearity of an armature-based receiver is compensated by modifying an electrical input signal applied to the receiver coil by a current amplifier with the following polynomial:

$$y=k_1x+k_3x^3+k_5x^5+\ldots+k_{2n+1}x^{2n+1} \quad \text{Eq. (4)}$$

Figure 7:
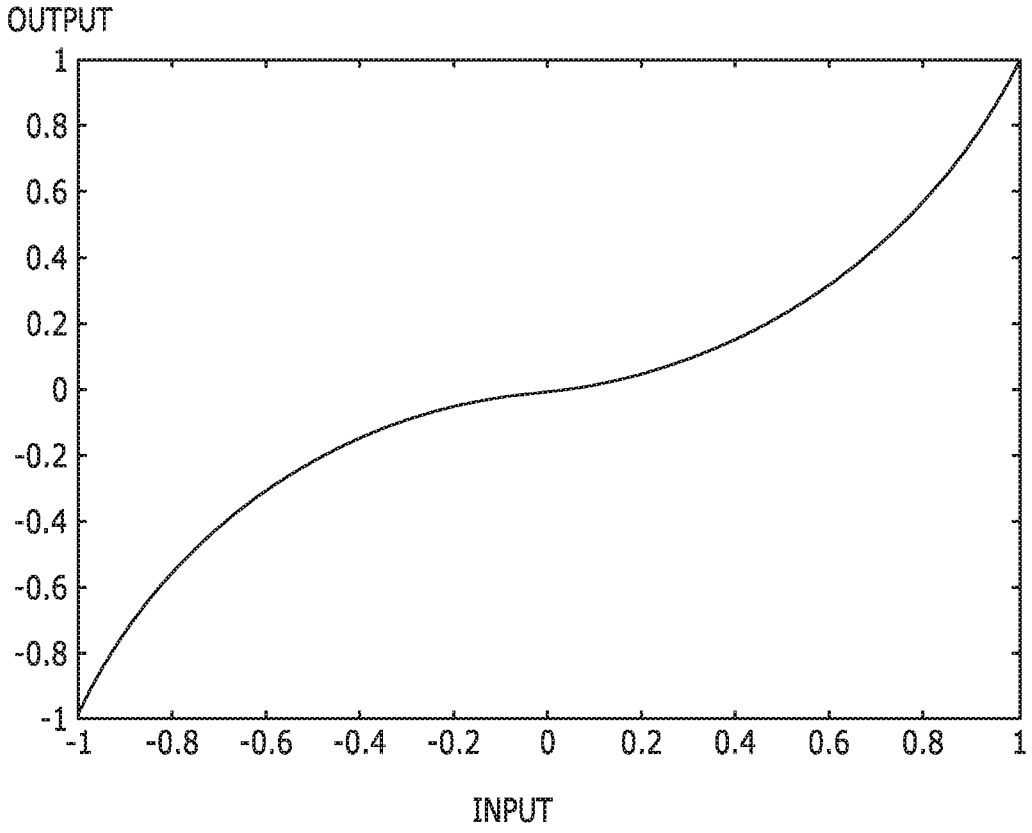
FIG. 7 is a graph of a computable non-linear function having an inverse sigmoid form.

In Equation (4), the variable x represents an electrical input signal representative of a desired acoustic output. The coefficients $k_n$ for the odd order terms compensate for predominant components of non-linearity of the receiver, mostly at frequencies below the primary mechanical resonance of the receiver. As discussed, odd order terms, for example, the $1^{st}$, $3^{rd}$ and $5^{th}$ order terms in Equation (4), compensate for symmetric non-linearity of the acoustic receiver. In armature-based receivers, symmetric non-linearity is attributable to magnetic saturation among other characteristics, some of which were discussed above. Thus the polynomial in Equation (4) compensates for non-linearity in the saturation region illustrated in FIG. 4. The polynomial of Equation (4) will provide reasonably effective compensation, particularly at higher magnitude or amplitude drive levels. For some armature-based receivers the coefficients for even ordered terms will be small or negligible. In some implementations, higher order terms may be eliminated with less but still noticeable improvement. In other implementations, compensation may be improved by adding one or more additional terms to the polynomial. FIG. 7 illustrates a graph of an odd polynomial represented by Equation (5) below:

$$y=0.28x+0.63x^3+0.10x^5 \quad \text{Eq. (5)}$$

where y is the "Output" and x is the "Input".

Generally, the computable non-linear function is selected and optimized for a particular receiver or for a class of receivers and in some implementations for particular processor. The term "optimize" or variations thereof as used herein means the selection of a computable non-linear function or parameters of such a function tending to reduce the output distortion of the receiver, at a specified SPL, when the receiver is driven by an electrical input signal that is pre-distorted by the function compared to the output distortion that would be obtained at the specified SPL when the receiver is driven by the electrical input signal without pre-distortion. Alternatively, optimization may also mean the selection of a computable non-linear function or parameters of such a function tending to increase SPL output of the receiver, for a specified distortion level, when the receiver is driven by an electrical input signal that is pre-distorted by the function compared to the SPL that would be obtained at the specified distortion level when the receiver is driven by the electrical input signal without pre-distortion. Optimization may also mean the selection of a computable non-linear function or parameters of such a function that satisfy a power consumption or processing and memory resource utilization constraints, among other considerations.

Optimization of the computable non-linear function may take many forms, including one or more of the selection of the function form or the selection of function parameters. Polynomial functions can be computed efficiently and selection of form of the computable non-linear function (e.g., odd or even order polynomial, approximated hyperbolic function . . . ) may be dictated, at least in part, by the receiver type or the predominant distortion (symmetric, asymmetric, or both) that requires compensation. Optimization may also occur by selection of a set of one or more parameters of the computable non-linear function. In embodiments where the computable non-linear function is approximated by a summation of a series of terms, the function may be optimized by selection of the order or coefficients of the function. These forms of optimization may be implemented readily and efficiently using a digital processer, for example, by implementing one or more iterative algorithms, examples of which are described below.

In some embodiments, the computable non-linear function (e.g., the polynomials in the examples above) are determined experimentally or using a numerical model of the acoustic receiver. A mathematical algorithm or some other iterative scheme may be used to select the form of the computable non-linear function and to select parameters of the function. Generally the form of the computable non-linear function is selected initially. A trial and error approach may be used to select the computable non-linear function that best compensates for a predominant distortion in a particular type of receiver or for a particular use case. Such an approach may be implemented by generating a pre-distorted excitation signal using different non-linear function forms, applying the pre-distorted excitation signal to a receiver, and evaluating the receiver output. Machine learning techniques or other mathematical algorithms are suitable for this purpose and may be used to facilitate form selection. The function form that results in the most desirable receiver output may be selected. Other than distortion compensation efficacy, the form of the function may be selected based on processor or memory resource requirements. Constraints may be imposed to ensure that the selection of the function does not result in undesirable results.

Upon selection of the form of the computable non-linear function, parameters of the function may be selected or optimized, through an iterative process, to improve performance of the receiver. For non-linear functions that comprise a summation of a series of terms, the order of and coefficients for the terms in the series among other parameters may be optimized through one or more iterative processes. To optimize a set of one or more parameters for a computable non-linear function, a known input signal, like a sinusoid, is pre-distorted using a previously selected non-linear function with a preliminary set of parameters. For example, a preliminary set of parameters could be coefficients or exponents of the polynomial of Equation (5). The preliminary set of parameters used during the first iteration may be based on a best guess, empirical data, or on parameters used previously for a similar receiver. The pre-distorted excitation signal is then applied to the input of a receiver or to a numerical model of the receiver and then the distortion of the resulting acoustic output of the receiver is evaluated. In a subsequent iteration, a new intermediate set of parameters is selected or determined based on the output distortion. The process iterates by making incremental changes to one or more parameters of the selected function based on a measure of the output distortion of the receiver until a desired output is attained. Considerations other than receiver output may also bear on the selection of the function parameters. For example, the form of the function or the number of terms in a series may impact the computational load on processing and memory resources. Additional terms in a series may provide a more linear output, or could be used to reduce clipping of the amplifier. Thus constraints may be imposed to ensure that the selection of the function parameters do not result in undesirable results.

The distortion of the acoustic output of the receiver may be determined using known techniques. For example, the distortion of the output signal may be estimated by computing its Total Harmonic Distortion (THD). Another approach is to compute THD+Noise for the output. Other measures of distortion may also be used. Algorithms for implementing these and other techniques for determining the distortion or linearity of an output signal are well known and not discussed further herein.

One such iterative methodology suitable for selecting or optimizing parameters of a computable non-linear function is a gradient descent algorithm. Other algorithms may also be used. These algorithms generally converge on a local minimum of the function. A minimum is identified when a rate of change of output signal distortion, with respect to some characteristic of the function, approaches zero. In some implementations however it may not be necessary to iterate until a minimum is reached. For example, the non-linear function could be optimized for a specified level of distortion without attaining a local minimum. The optimized function or a set of parameters associated with the function may be stored in a memory device associated with the acoustic receiver for subsequent use.

Optimization of the computable non-linear function may be implemented by a test system after production of the acoustic receiver as discussed in connection with the system 800 of FIG. 8. In other embodiments however the optimization is implemented by a processor or integrated circuit associated with the receiver as discussed below. The system 800 optimizes a computable non-linear function for an acoustic receiver having an initial operating characteristic or for a receiver or a class of receivers having the initial characteristic. The system 800 includes a function or inverse model generator 802 that optimizes the computable non-linear function until the output distortion of the receiver satisfies a criterion (e.g., a specified output distortion level). As suggested above, the inverse model generator may select the computable non-linear function form or select parameters of the function or both. As discussed above, the approach to selecting the form of the function will generally be different than the approach to selecting parameters of the function. The system 800 also includes a pre-distorted electrical excitation signal generator 804 that generates a pre-distorted electrical excitation signal by applying an input signal representative of the desired acoustic output to the non-linear function generated by the inverse model generator. The input signal is generated or provided by an input signal source 806. The input signal may be a sinusoidal test signal. During optimization, pre-distorted electrical excitation signals are iteratively applied to the receiver 810 and the function is iteratively updated based on iterative measures of the output distortion until the output distortion of the receiver satisfies some criterion.

Figure 8:
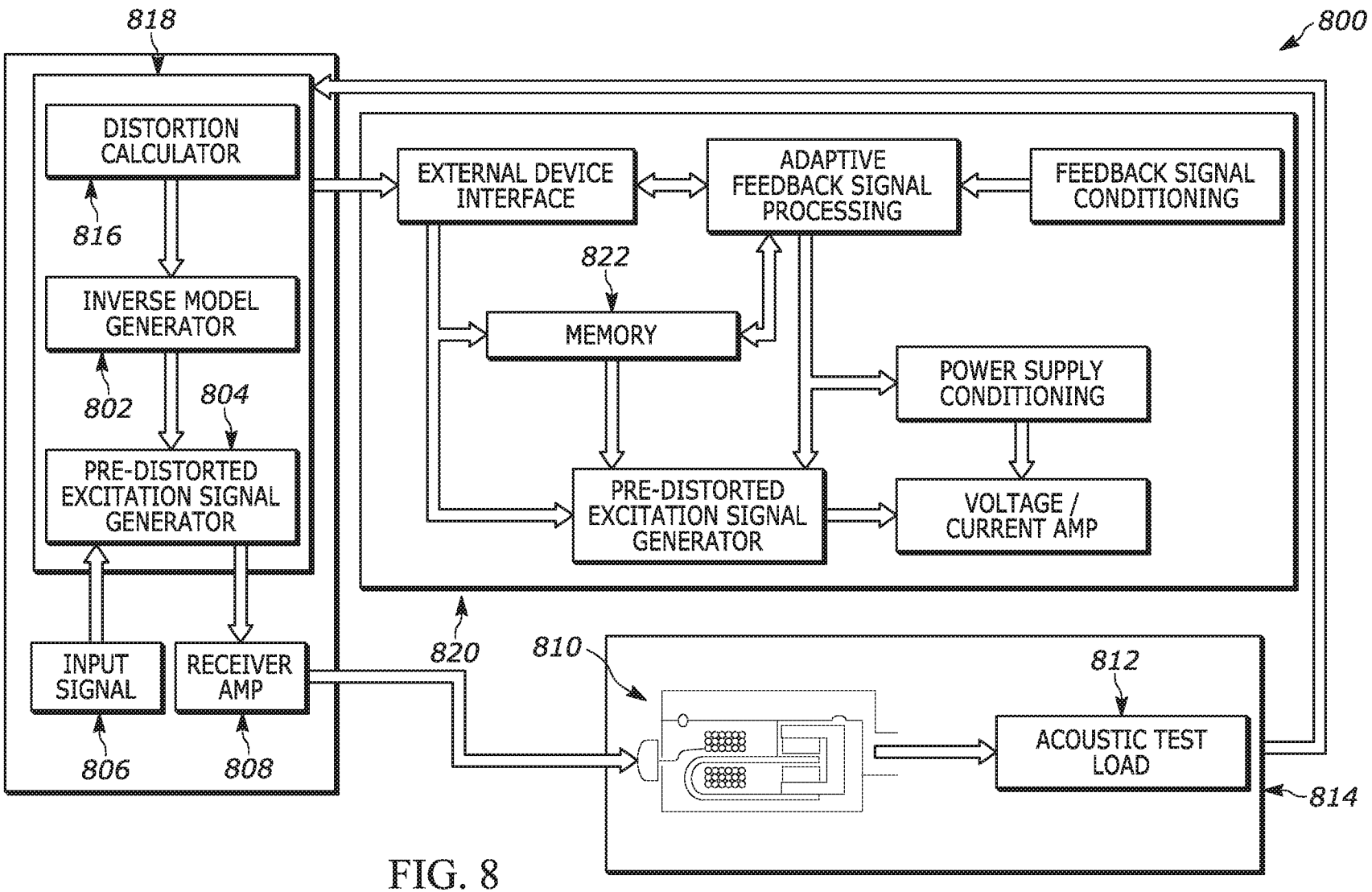
FIG. 8 is a test system for determining parameters for a non-linear function.

In FIG. 8, the pre-distorted electrical excitation signal is applied to the receiver 810 by a current or voltage amplifier 808. The acoustic output of the receiver is input to an acoustic test load 812 that models an acoustic load of the receiver. Such a load may represent acoustic tubing, the user's ear anatomy, acoustic leakage, among other load variables, some of which are discussed elsewhere herein. A microphone converts the acoustic output signal to an electrical signal that is fed back to a distortion calculator 816. The microphone may be part of the receiver or test load. The distortion calculator 816 calculates the distortion of the electrical signal provided by the acoustic test load 812 as discussed above. The result of the distortion computation is provided to the inverse model generator 802 for optimizing the non-linear function in the next iteration. The process iterates until the receiver output satisfies a specified criterion. After selection or optimization of the computable non-linear function, the non-linear function is stored in memory on, or associated with, the receiver for subsequent use as discussed below.

In one implementation, the inverse model generator 802, the pre-distorted excitation signal generator 804, and the distortion calculator 816 are implemented by a digital processing device 818. While the inverse model generator, the pre-distorted signal generator, and the distortion calculator are schematically illustrated as separate functions, these functions may be implemented by executing one or more algorithms on one or more processors represented schematically as processor 818. In some embodiments, the input signal used to optimize the non-linear function is also generated by the processor 818 and thus the input signal source 806 may also be implemented as a signal generating algorithm, like a sine wave generator, executed by the processor. Alternatively, the input signal may be obtained from an external source.

In another implementation, the receiver 810 and the test load 812 of FIG. 8 are represented by a numerical model representative of a particular receiver or a class of receivers. The model is illustrated schematically at 814. According to this embodiment, the computable non-linear function is determined by iteratively applying intermediate pre-distorted electrical excitation signals to the model of the receiver and the load. The model 814 outputs a signal representative of the acoustic output of the modeled receiver in response to application of a pre-distorted input signal to the model. The output of the model 814 is provided to the distortion calculator 816 for analysis. The distortion calculator determines the distortion of the output signal fed back from the model, and the result is provided to the inverse model generator for the next iteration. In this embodiment, the amplifier 808 is a virtual device that may be implemented by the processor 818. The numerical model 814 of the receiver and load may also be implemented by the processor 818. Numerical models based on analogous electrical equivalents of receivers are known generally and a representative model of an armature-based receiver is described below with reference to FIGS. 11A and 11B.

After selection or optimization of the computable non-linear function, the function is written to a memory device on, or associated with, the receiver for end-use. The memory device may be a discrete component or it may be part of an integrated circuit, like an ASIC, disposed in or on the receiver. The memory device or integrated circuit may also be located on another component used with the receiver or in or on a device or system with which the receiver is integrated. Such a device or system may be a hearing instrument, like a set of headphones or a hearing-aid device, among other examples discussed herein. In FIG. 8, the processor 818 writes the computable non-linear function or function parameters to a memory device 822, which may be part of an integrated circuit 820 associated with the receiver.

In some implementations, an alternative set of parameters is determined for a characteristic of the acoustic receiver that is different than the initial characteristic. The alternative set of one or more parameters are optimized by iteratively applying intermediate parameters to the receiver with the different characteristic and assessing the output distortion as discussed above. A parameter model representative of the alternative set or sets of parameters is stored in the memory device associated with the receiver in anticipation of changes in a characteristic of the receiver while in use by the end-user. The parameter model generally relates the alternative set or sets of parameters to information indicative of corresponding characteristics of the receiver. The alternative sets of parameters may be generated by the system 800 of FIG. 8 or by a processor or integrated circuit associated with the receiver as discussed in connection with FIG. 9. The parameter models may be embodied as one or more look-up tables or as one or more continuous or piece-wise linear functions. According to this aspect of the disclosure, operational conditions indicative of a change in characteristic or configuration of the receiver are monitored during operation of the receiver, in some cases using sensors located on or near the receiver. Upon detecting a condition indicative of a change in a characteristic of the receiver, information indicative of the change is fed back to a processor associated with the receiver and the parameters are updated using the parameter model to compensate for the change. Some examples of the use of the alternative parameters are discussed below. More generally, this approach may be used to select a different non-linear function form or parameters of the selected function to compensate for a change in a characteristic of the receiver.

In use, the acoustic receiver having a non-linear transfer characteristic is associated with an electrical signal conditioning apparatus including a processor that generates the pre-distorted electrical excitation signal by applying an electrical input signal (x) representative of a desired acoustic output to a computable non-linear function optimized for the receiver. As discussed above, the pre-distorted electrical excitation signal is the output of the non-linear function. In one implementation, the non-linear function includes at least one term that is proportional to $x^n$, where n is not equal to unity. Generally, when applied to an input of the receiver having a non-linear transfer characteristic, the pre-distorted electrical excitation signal improves the performance of the receiver. In armature-based receivers, an acoustic output of the receiver is produced by deflecting the armature relative to one or more magnets upon applying the pre-distorted electrical excitation signal to a coil of the receiver. In one embodiment, for a specified distortion level, a sound pressure level of the acoustic output produced in response to the pre-distorted electrical excitation signal is greater than a sound pressure level that would be produced, at the specified distortion level, in response to the electrical excitation signal without pre-distortion. In another embodiment, for a specified acoustic sound pressure level, the acoustic output produced in response to the pre-distorted electrical excitation signal has less distortion than an acoustic output that would be produced in response to the electrical excitation signal without pre-distortion. In other implementations, the pre-distorted electrical excitation signal provides some other beneficial effect, like efficient processing and memory resource utilization.

Figure 9:
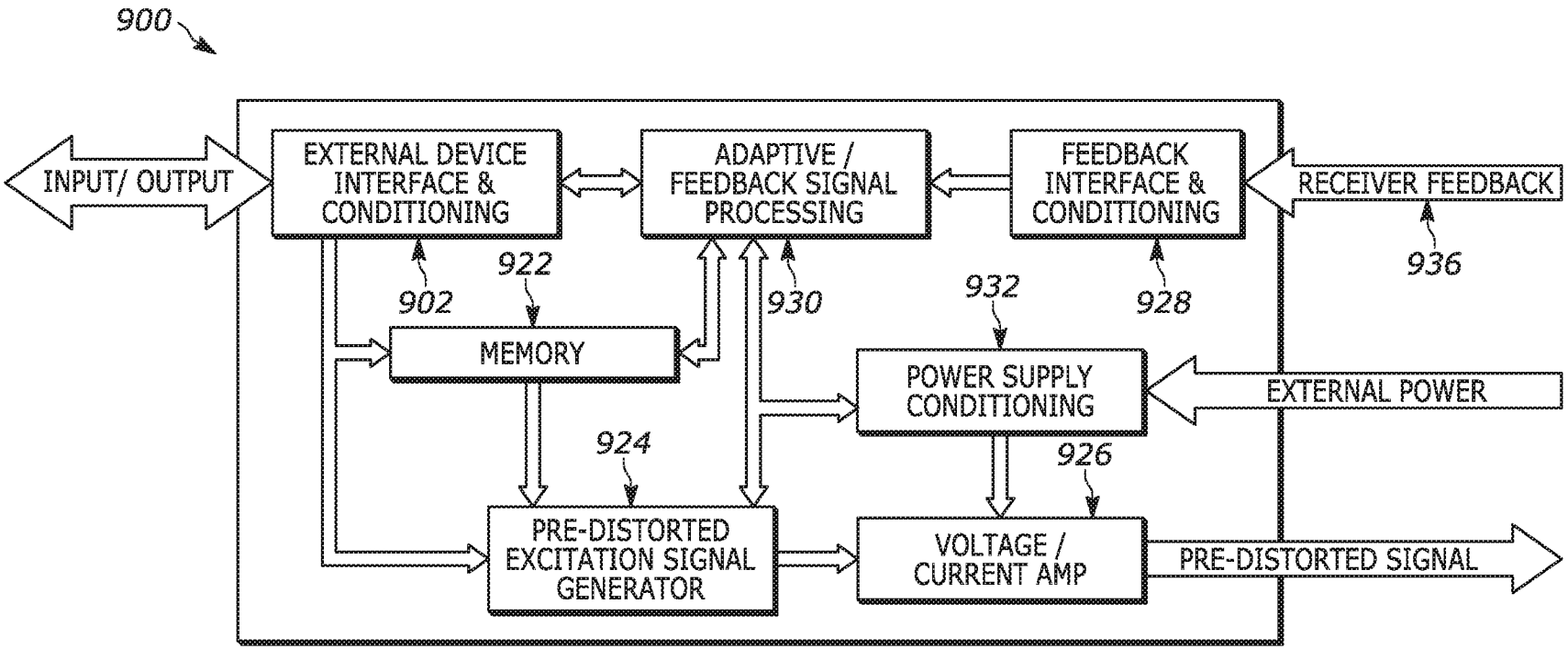
FIG. 9 is a schematic block diagram of an integrated circuit used in combination with a receiver.

FIG. 9 illustrates an integrated circuit (IC) 900 for use in combination with an acoustic receiver. While FIG. 9 illustrates different features and functions on a single circuit, for example, an ASIC, these features and functions may be performed by multiple circuits in alternative embodiments. The one or more discrete circuits or ASICs are located in or on a receiver or a system with which the receiver is integrated, examples of which are discussed herein. The IC includes an external device interface 902 that enables communications between the receiver and external devices like system 800 of FIG. 8, hearing-aid circuits, and circuits of audio headsets and other audio systems with which the receiver is integrated. For example, the system of FIG. 8 may communicate the computable non-linear function, function parameters, parameter models, numerical models of the receiver, and other information to a memory device 922 via the interface 902 in FIG. 9. An input signal representative of the desired acoustic output may also be communicated to the integrated circuit via the external device interface prior to generation of the pre-distorted electrical excitation signal. Such an input signal may originate from a microphone or from a media content source or from some other audio signal source. The integrated circuit may also communicate information to other circuits of the receiver or system with which the receiver is integrated via the external device interface. For example, a hearing instrument may have a separate processor with which the circuit 900 communicates. The external device interface 902 is also representative of signal conditioning that may be performed on signals received by, and transmitted from, the circuit 900. Such conditioning may include analog-to-digital A↔D conversion, signal format conversion (e.g., PDM↔PCM), and other signal conditioning.

FIG. 9 also illustrates a pre-distorted excitation signal generator 924 that generates the pre-distorted electrical excitation signal by applying the input signal representative of a desired acoustic output to the computable non-linear function. The signal generator 924 of FIG. 9 is similar to the generator 804 of the system of FIG. 8. As suggested, the input signal representative of the desired acoustic output may be input at the external device interface 902 by other circuits of the device or system with which the receiver is integrated. In FIG. 9, the pre-distorted electrical excitation signal is provided to an amplifier 926 for subsequent input to the receiver. The amplifier 926 is shown as part of the integrated circuit, but in other embodiments, the amplifier may be a discrete circuit or device disposed between the integrated circuit and the receiver. The amplifier may be embodied as a voltage amplifier or a current amplifier. A current amplifier may be embodied as a current-in/current-out amplifier or a transconductance amplifier having voltage input and a current output.

In some embodiments, a processor associated with the receiver generates an updated computable non-linear function to accommodate a change in characteristic of the receiver. The non-linear function is updated with an alternative set of parameters. For this purpose, a condition of the receiver indicative of a change in characteristic is sensed and information indicative of the change is fed back to the processor. Such conditions of the receiver can be detected by monitoring or sensing changes in receiver impedance, front volume pressure, back volume pressure, receiver output SPL, among other detectable conditions of the receiver. The processor generates an updated non-linear function, for example, by applying an updated set of parameters to the non-linear function.

In FIG. 9, for example, the integrated circuit 900 associated with the receiver includes a feedback interface and conditioning circuit 928 for receiving information from the receiver. The interface 928 is also representative of signal conditioning that may be performed on signals 936 from the receiver, including A/D conversion, signal format conversion, and other signal conditioning. The interface 928 is shown schematically separately from the interface 902, but these interfaces may be implemented as a common interface in other embodiments. The feedback interface is coupled to a processor 930 that assesses the receiver feedback and determines an updated non-linear function using models stored in memory 922. The updated non-linear function is also stored in memory.

Figure 10:
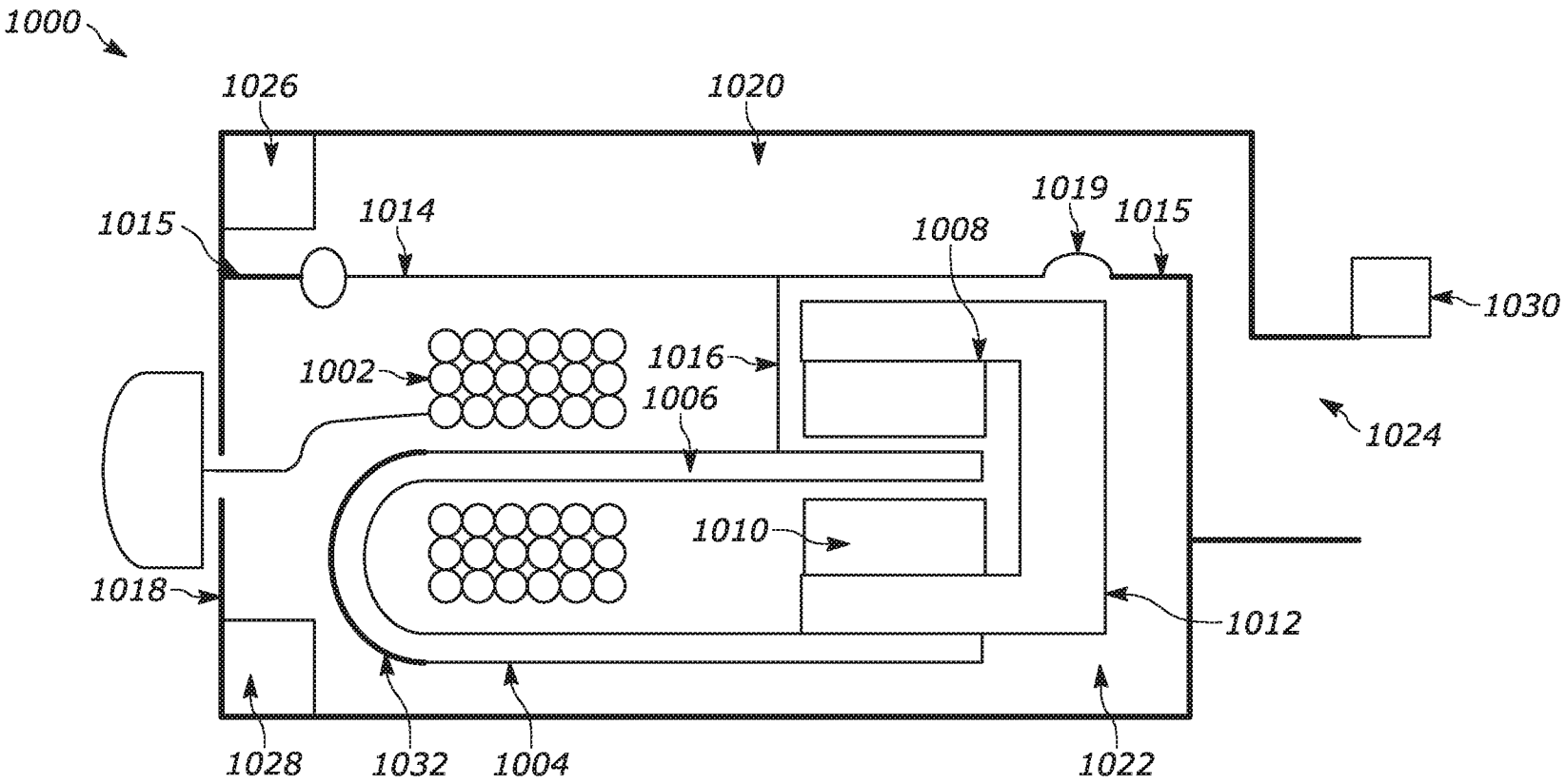
FIG. 10 is a schematic block diagram of a receiver.

FIG. 10 is a schematic block diagram of an armature-based receiver 1000 comprising a coil 1002 disposed about a portion of an armature 1004. The armature has a movable portion 1006 that deflects between magnets 1008 and 1010 upon application of an excitation signal to the coil. The magnets are retained by a yoke 1012. The movable portion of the armature is coupled to a paddle 1014 by a linkage 1016. The paddle is hinged or otherwise movably coupled to a support structure 1015 retained by a receiver housing 1018. A flexible membrane 1019 bridges a gap between the paddle and the support structure, and the combination forms a diaphragm. The diaphragm divides the housing 1018 into a front volume 1020 and a back volume 1022. Deflection of the armature moves the paddle resulting in changes in air pressure in the front volume wherein acoustic pressure (e.g., sound) is emitted through an output port 1024 of the receiver. The schematic receiver diagram of FIG. 10 is representative of any armature-based receiver architecture. For example, other receivers may have different armatures or yoke configurations, among other configurations.

As suggested above with reference to FIG. 9, in some embodiments, the receiver provides information about a changing configuration or characteristic of the receiver for which it may be desirable to update the non-linear function used to pre-distort the input signal. Some of these changing characteristics may be detected by monitoring conditions of the receiver with sensors on the receiver or in the integrated circuit, like the circuit of FIG. 9. For example, the impedance of the receiver may be monitored by sensors in the amplifier circuit or by other circuits. The monitoring of other conditions however may require additional sensors on the receiver. In FIG. 10, for example, pressure sensors 1026 and 1028 may be used to monitor changes in air pressure in the front and back volume of the housing, and an acoustic sensor 1030 may be used to convert the acoustic output of the receiver to an electrical signal that may be analyzed for distortion and for other characteristics as discussed below. In FIG. 9, information from the receiver indicative of these and other changing receiver characteristics are illustrated schematically at 936. Some specific examples are discussed below.

Figure 13:
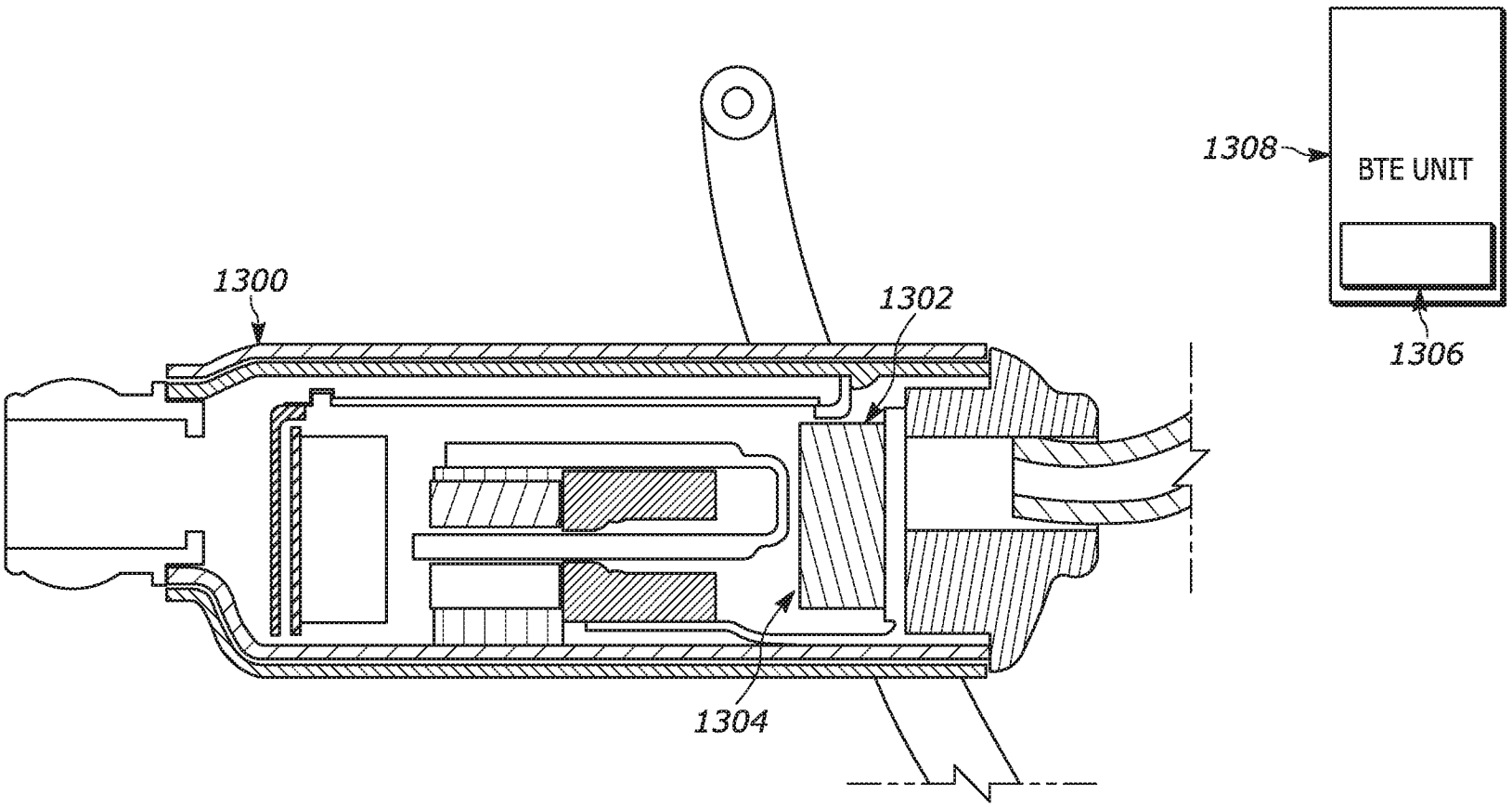
FIG. 13 illustrates a system in which an armature-based receiver is integrated.

As suggested above, some or all of the functionality of the circuits of FIG. 9 may be implemented in the receiver or in some other part of the system with which the receivers is integrated. FIG. 13 shows a receiver 1300 having the integrated circuit embodied as an ASIC 1302 disposed within a back volume 1304 of the receiver housing. More generally, the receiver 1300 could have some other form. In other embodiments, some or all of the circuit functionality may be disposed in some other part of the device or system with which the receiver is integrated. In hearing aid implementations, for example, an integrated circuit 1306 having some or all of the functionality of the circuits of FIG. 9 may be disposed in a behind the ear (BTE) unit 1308. In other implementations, some or all of these circuits may be disposed in a housing of a headphone or in a portion of some other system with which the receiver is integrated.

One circumstance that may affect receiver output is a change in the initial steady-state (i.e., rest) position of the reed between the magnets. The initial rest position of the reed is typically a balanced position but in some embodiments it may be unbalanced. Such a change in rest position of the reed may result from an impact or other shock to the receiver. As discussed above, it may be desirable to update the computable non-linear function to accommodate the change in reed rest position. One approach, among others, is to update the function by applying an alternative set of parameters to the function. Table 1 below shows an initial set of polynomial coefficients for an initial rest position of the reed identified as position $x_0$. According to this example, alternative sets of optimized parameters may be computed for different reed rest positions (e.g., $+/-x_1$, $+/-x_2$ . . . ) relative to the initial rest position (i.e., $x_0$). The alternative parameters may be computed by the system of FIG. 8 for different reed rest positions using an iterative approach described herein. Different reed rest positions may be obtained by applying different +/−DC bias voltages to the magnetic circuit of the receiver. Alternatively, the alternative sets of parameters may be determined by iteratively applying intermediate pre-distorted excitation signals to a model of the receiver with different reed rest positions using a virtual amplifier. The optimized set of alternative parameters may be tabulated for each reed position as follows:

TABLE 1

| Reed Rest Position | Polynomial Parameters | | | |
|---|---|---|---|---|
| . . . | . . . | . . . | . . . | . . . |
| $+x_2$ | $k_{02}$ | $k_{12}$ | $k_{22}$ | . . . |
| $+x_1$ | $k_{01}$ | $k_{11}$ | $k_{21}$ | . . . |
| $x_0$ | Initial Parameters | | | |
| $-x_1$ | $-a_{01}$ | $-a_{11}$ | $-a_{21}$ | . . . |
| $-x_2$ | $-a_{02}$ | $-a_{12}$ | $-a_{22}$ | . . . |
| . . . | . . . | . . . | . . . | . . . |

Generally, there may be more or less parameter sets than those illustrated in Table 1, depending on the particular non-linear function implemented. For example, Equation (4) above requires computation of only coefficients for the $1^{st}$, $3^{rd}$ and $5^{th}$ order terms. In some embodiments, the data of Table 1 are stored in the memory of the receiver as a look-up table. The look-up table may be subsequently referenced by the receiver processor to determine an updated set of parameters based on a detected change in rest position. The updated parameters may then be applied to the non-linear function for use in pre-distorting the input signal. In some embodiments, the algorithm implementing the look-up table includes interpolation functionality that computes sets of parameters for reed rest positions that are between the rest positions for which the tabulated data was determined. The algorithm implementing the look-up table may also include extrapolation functionality that computes sets of parameters for reed rest positions that are beyond the positions for which the tabulated data was determined. The interpolation and extrapolation functions may be based on linear or non-linear approximations relative to the tabulated data points.

In other embodiments, the alternative sets of parameters of Table 1 may be used to formulate one or more mathematical functions that model the relationship between reed rest positions and corresponding sets of function parameters. The functional model could be a single function or a set of piece-wise linear or non-linear functions. For example, a separate function or set of functions could be used to model each parameter as a function of reed rest position. Such functions may be generated using known curve fitting techniques such as regression analysis or other function approximation methodologies. Like the look-up tables, these functional models may be stored on the receiver for use in updating the set of parameters upon detecting a change in reed rest position. The use of interpolation or extrapolation algorithms may not be required where mathematical functions are used to model the relationship between reed rest position and sensed information indicative of the change in reed rest position. The look-up table or the function relates information from the receiver representative of the change in reed rest position (e.g., impedance, strain, pressure . . . ) to corresponding set of parameters.

A change in reed rest position, also referred to as change in receiver balance, may be detected directly or indirectly. In one implementation, a reed rest position change is detected by monitoring a change in receiver impedance. Receiver impedance may be detected directly by measurement at the receiver coil. Alternatively, a change in reed rest position may be monitored using a reed strain gauge. FIG. 10 illustrates a strain gauge 1032 disposed on a portion of the reed 1004 for this purpose. The change in reed rest position may also be monitored by measuring changes in air pressure of the receiver using one or more pressure sensors, for example the sensor 1026 located in the front volume, the sensor 1028 in the back volume, or by using pressure sensors located in both the front and back volumes. Thus Table 1 above or any corresponding function(s) may relate the alternative sets of coefficients or other function parameters to anyone of these detectable conditions.

Another circumstance that may affect receiver output is a change in frequency response of the receiver. Such a change may be attributable to acoustic leakage in the hearing instrument (e.g., hearing aid, headphones, etc.), ear wax accumulation in a hearing-aid acoustic passage, among other changing characteristics of the receiver or system that occur in use. As suggested above, an optimized set of initial parameters are calculated for an initial frequency response fo of the receiver. Alternative sets of parameters may also be determined for different frequency responses of the receiver. For example the frequency response could be changed by incrementally changing acoustic leakage of the test load and new sets of parameters may be calculated for each incremental change. Alternative sets of parameters may also be determined for incremental changes in acoustic blockage that correspond to wax accumulation in a hearing-aid. The frequency response of the receiver may also be changed based on other changing characteristics of the receiver as well and alternative sets of parameters may be determined accordingly. Like the example above, the alternative sets of parameters are iteratively optimized for each incremental change to an actual receiver. Alternatively, the alternative sets of parameters are optimized using a model of the receiver and the load. The alternative set of parameters optimized for different frequency responses of the receiver may be tabulated as follows:

TABLE 2

| Frequency Response | Filter Parameters | | | |
|---|---|---|---|---|
| $f_0$ | Initial Parameters | | | . . . |
| $f_1$ | $b_{11}$, $a_{11}$ | $b_{12}$, $a_{12}$ | $b_{13}$, $a_{13}$ | . . . |

TABLE 2-continued

| Frequency Response | Filter Parameters | | | |
|---|---|---|---|---|
| $f_2$ | $b_{21}$, $a_{11}$ | $b_{22}$, $a_{22}$ | $b_{23}$, $a_{23}$ | . . . |
| . . . | . . . | . . . | . . . | . . . |

Generally, there may be more or less parameter sets than illustrated in Table 2 depending on the function implemented (e.g., whether the function is odd or even). In some embodiments, the data in Table 2 are stored in the memory of the receiver as a look-up table. The look-up table may be subsequently used by the receiver to determine updated parameters based on detected changes in various receiver characteristics (including load characteristics) indicative of a change in frequency response. In some embodiments, the algorithm implementing the look-up table includes interpolation or extrapolation functionality that computes sets of parameters for changes in frequency response between or beyond the positions for which the tabulated data was determined, as discussed above. In other embodiments, the parameters in Table 2 are used to formulate one or more mathematical functions that model the relationship between frequency response and information indicative of the change in receiver characteristic. For example, a separate function could be used to model each parameter as a function of frequency response. Such functional models may be generated using known curve fitting techniques like as regression analysis or other function approximation methodologies as discussed above. Like the look-up tables, these functions may be stored on the receiver for use in updating the parameters upon detecting a condition indicated of a change in frequency response.

The change in receiver frequency response may be detected by monitoring changes in resonance peaks and other characteristics of the frequency response. In one embodiment, the frequency response of the receiver is monitored using a Fast Fourier transform (FFT) or Discrete Fourier Transform (DFT) applied to an electrical signal representative of the receiver output. The electrical signal may be generated using a microphone disposed at the output of the receiver. FIG. 10 illustrates schematically an acoustic receiver 1030 located just outside or inside the receiver output port for this purpose. Another approach is to apply a test signal at a resonant frequency of the receiver and measure a magnitude of the electrical signal representative of the output at one or more resonance frequencies. The look-up table, e.g., Table 2 above, or a functional model may be used to relate the sets of parameters to FFT or DFT outputs or other sensed conditions indicative of the change in frequency response.

In some embodiments, it may be desirable to control the amplifier output for changes in a characteristic of the receiver. For voltage driven receivers, it may be desirable to adjust the output (e.g., magnitude or phase) of a voltage amplifier to compensate for a changing impedance of the receiver. For example, the magnitude or phase of the voltage amplifier output may be adjusted as the receiver impedance changes to provide a more constant current level or to control the phase of the amplifier output signals. The receiver impedance can be measured directly at the receiver coil and sensed changes may be used to control the voltage of the amplifier. For current amplifier driven receivers, it may be desirable to adjust the output (e.g., amplitude or phase) to compensate for changing receiver characteristics. In FIG. 9, the processor 930 adjusts or compensates the output of the amplifier 926 using conditioning circuit 932 based on a changing receiver characteristic indicated by feedback 936. In battery powered devices, the battery provides power to the conditioning circuit. The conditioning circuit 932 may also include a voltage regulator, charge pump, and other power supply conditioning circuits.

In one embodiment, the computable non-linear function or parameters of the function are selected by the electrical circuits associated with the receiver system rather than by a test system like the system 800 of FIG. 8. According to this aspect of the disclosure, the functionality of the input signal generator 806, distortion calculator 816 and the inverse model generator 802 of FIG. 8 are implemented by a processor associated with the receiver. For example, this functionality could be implemented by one or more processors of integrated circuit 900 of FIG. 9. A sensor on the output of the receiver can provide output signal distortion feedback from which the initial computable non-linear function may be updated. Thus configured, the processor associated with the receiver can generate and optimize the non-linear function for an initial characteristic of the receiver or for subsequent characteristics of the receiver by applying a pre-distorted test signal to the input of the receiver and implementing one of the iterative processes discussed herein until the desired level of output distortion is attained. The non-linear function may be optimized from time to time to accommodate or compensate for changes in the initial characteristic of the receiver. Implementing non-linear function optimization on the processor associated with the receiver may eliminate the need to perform some or all of the optimization on the system 800 discussed above in connection with FIG. 8.

Figure 11A:
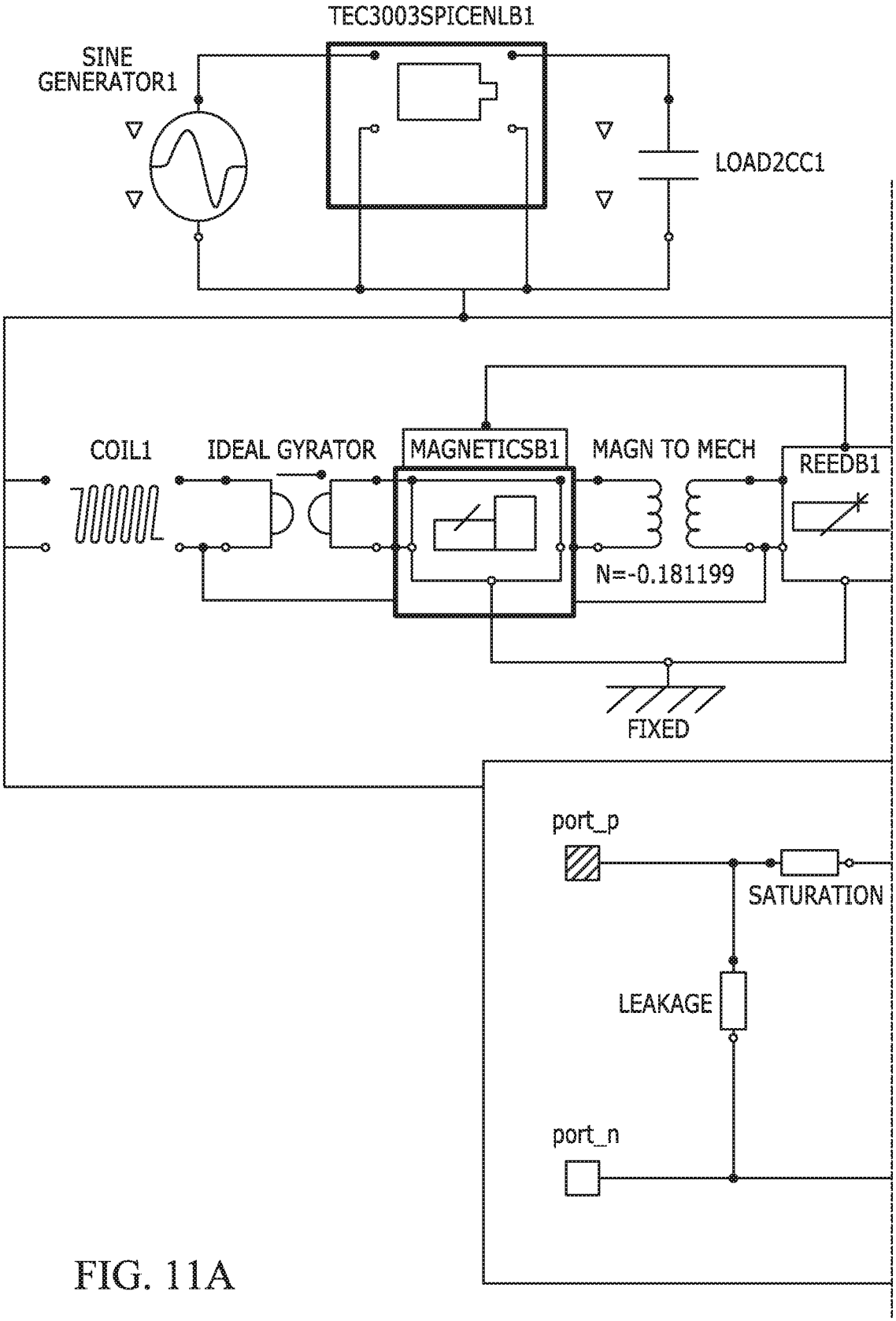
FIGS. 11A and 11B are graphical representations of a computable model of an armature-based receiver.
Figure 11B:
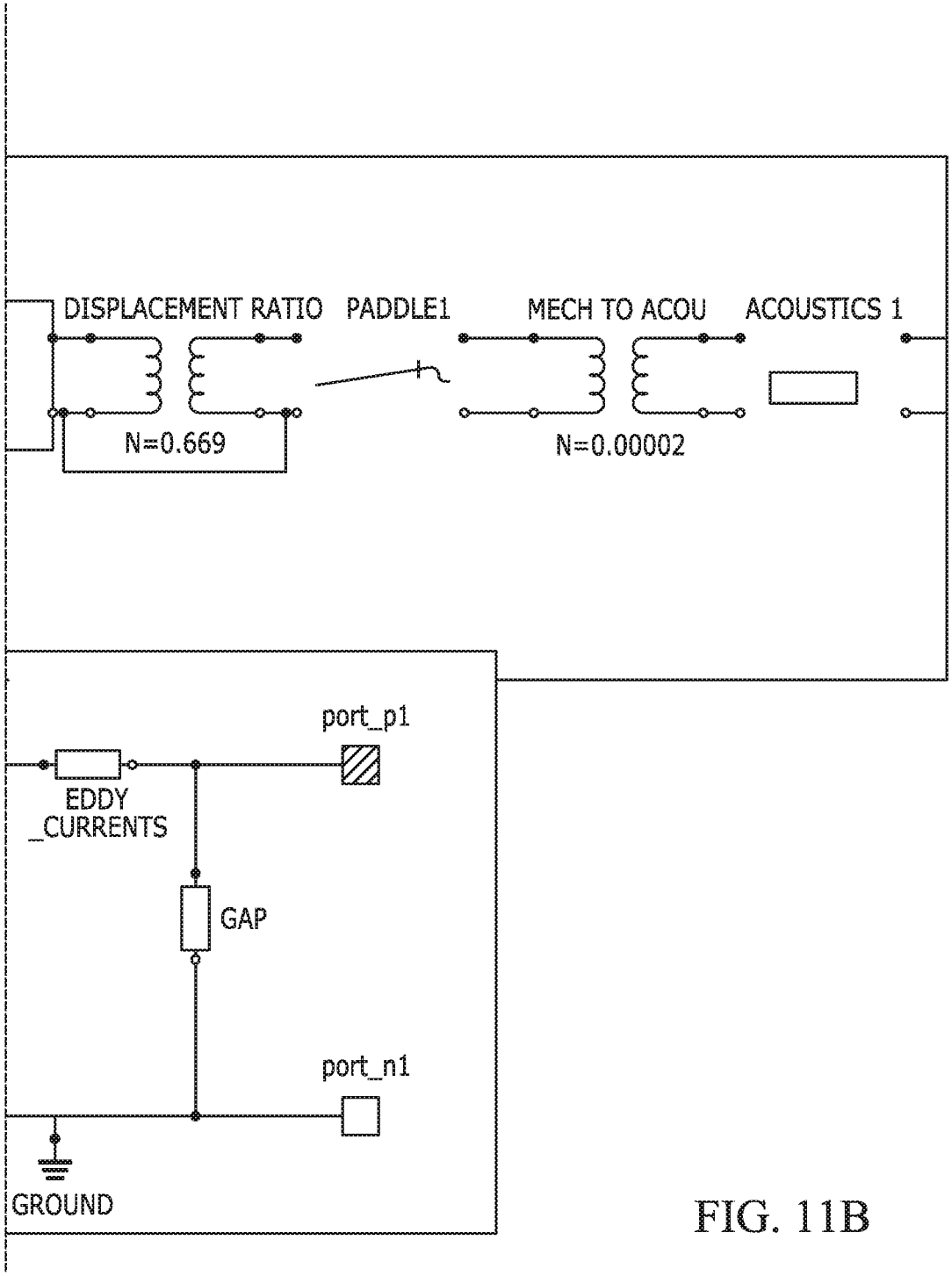
Figure 12:
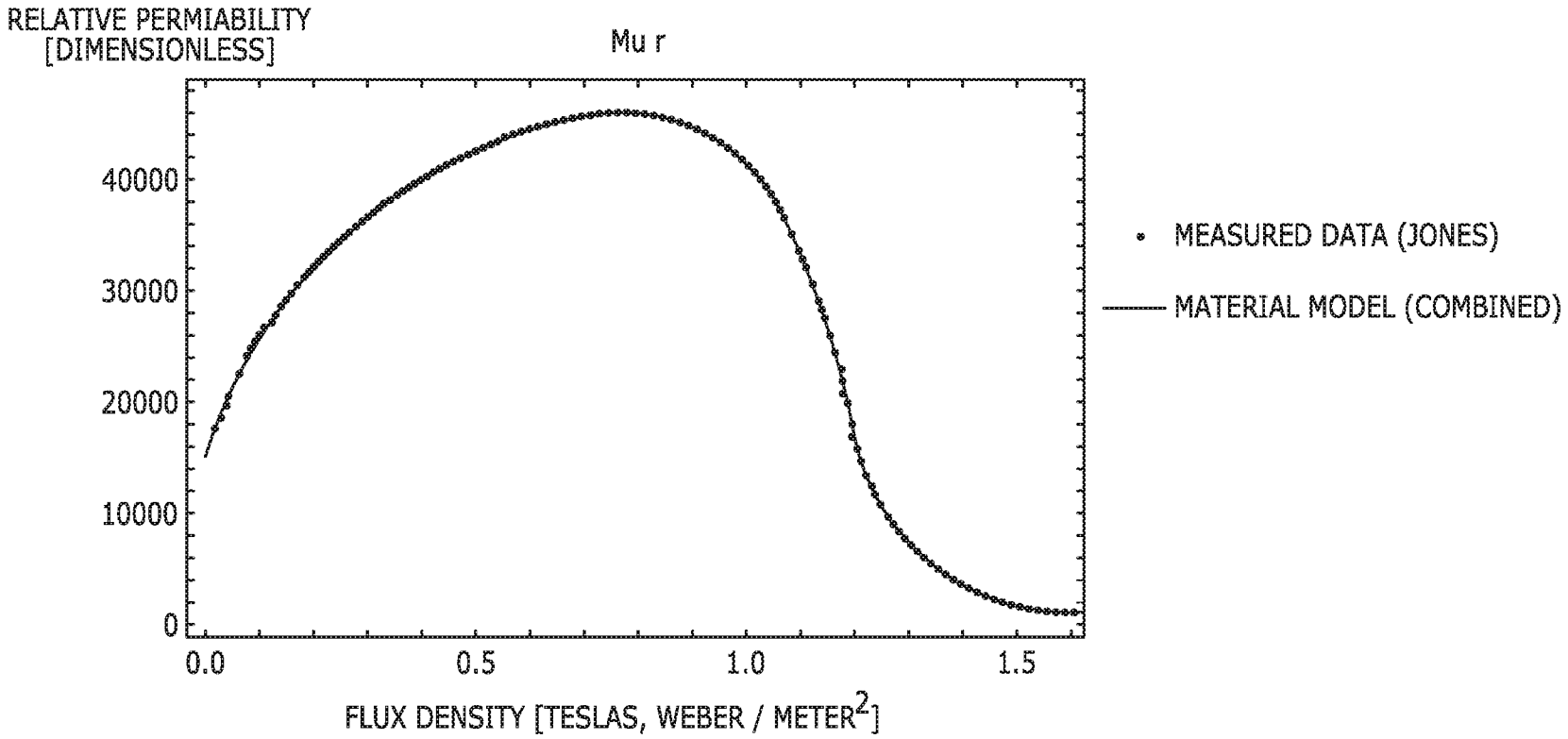
FIG. 12 is a plot of relative permeability versus flux density.

FIGS. 11A and 11B are schematic representations of an equivalent circuit model of a receiver that may be implemented numerically. The model is based on electrical analogies (tec30033spiceNLB1) having a signal source (sineGenerator1) and a load (load2CC1). This technique produces a linear model of a receiver. The model typically includes a current variable and a voltage variable. Such a model can be implemented by several commercial programs, like SPICE. The numerical model is a transformation of receiver components into the electrical domain wherein masses are represented by inductors, stiffness by capacitors, losses by resistors, acoustical cavities by capacitors, acoustical lengths by inductors, and viscous damping effects by resistors. In FIGS. 11A and 11B, pure magnetic reluctances (e.g., saturation, gap, and leakage elements) are transformed, or modeled, as capacitors. In the magnetic domain, reed saturation, negative stiffness, leakage and air gaps are modeled along with losses due to eddy currents. According to this model, the parameter describing the magnitude of the capacitor (representing armature saturation) is changed according to the flux density and proportional to the permeability of the reed. Total flux is the sum of the flux generated by the coil and the flux from magnets diverted into the armature as a function of position minus the flux lost due to leakage. The total flux divided by the cross-sectional area of the reed is the flux density that can be converted to a permeability through the function shown in FIG. 12. The model of the receiver will perform substantially similarly to a real device. The model can be used to determine parameters using the iterative approach described above. Second, since the equations are now described in the model, a detailed inverse model can be created. The inverse model could be directly applied to the input signal to produce the pre-distorted output.

While the present disclosure and what is presently considered to be the best mode thereof has been described in a manner that establishes possession by the inventors and that enables those of ordinary skill in the art to make and use the same, it will be understood and appreciated that there are many equivalents to the exemplary embodiments disclosed herein and that myriad modifications and variations may be made thereto without departing from the scope and spirit of the disclosure, which is to be limited not by the exemplary embodiments but by the appended claims.

The invention claimed is:

1. An acoustic receiver having an armature and a non-linear transfer characteristic, the receiver comprising:

a coil disposed about an armature, a portion of the armature free to deflect between magnets of the receiver in response to application of a pre-distorted electrical excitation signal to the coil, the pre-distorted electrical excitation signal is an output of a computable non-linear function of an electrical input signal (x) representative of a desired acoustic output;

an output port capable of producing an acoustic output in response to application of the pre-distorted electrical excitation signal to the coil, wherein, for a specified acoustic sound pressure level, the acoustic output produced in response to the pre-distorted electrical excitation signal has less distortion than an acoustic output that would be produced in response to the electrical input signal (x) without pre-distortion.

2. The receiver of claim 1 further comprising a diaphragm with a movable portion linked to the armature, wherein movement of the armature translates into movement of the diaphragm, a housing including the output port, the armature and the diaphragm disposed at least partially within housing, wherein movement of the diaphragm causes the receiver to produce the acoustic output.

3. The receiver of claim 1, the magnets having a magnetic field that applies a magnetic force to the movable portion of the armature, wherein the magnet force is stronger than a mechanical restoring force of the armature.

4. The receiver of claim 1 in combination with, a processor coupled to memory, the computable non-linear function stored in the memory, the processor configured to generate the pre-distorted electrical excitation signal by applying the electrical input signal (x) to the computable non-linear function.

5. The receiver of claim 1, the computable non-linear function is a function that can be approximated by a function including at least one term that is proportional to $x^n$ where n is not equal to unity.

6. The receiver of claim 4, the processor configured to generate an updated pre-distorted electrical excitation signal using a computable non-linear function that is updated based on information indicative of a change in characteristic of the receiver;

an amplifier having an output coupled to the coil of the receiver, wherein the updated pre-distorted electrical excitation signal compensates for the change in characteristic of the receiver when the updated pre-distorted electrical excitation signal is applied to the coil.

7. The receiver of claim 6, the change in characteristic of the receiver is a change in balance of the receiver.

8. The receiver of claim 6, the change in characteristic of the receiver is a change in frequency response of the receiver.

9. The apparatus of claim 4, the processor configured to generate the computable non-linear function using a process that iterates until distortion at an output of the receiver is reduced to a specified level.

10. An apparatus for configuring an acoustic receiver to generate a pre-distorted electrical excitation signal from an electrical input signal (x) representative of a desired acoustic output, the receiver having an armature and a non-linear transfer characteristic attributable to the armature, the apparatus comprising:

an interface connectable to memory associated with the receiver;

a processor configured to optimize a computable non-linear function for the receiver, the computable non-linear function is a function of the electrical input signal (x), the optimized computable non-linear function capable of outputting a pre-distorted electrical excitation signal in response to the electrical input signal (x), the processor configured to provide the optimized computable non-linear function to the interface connectable to the memory associated with the receiver.

11. The apparatus of claim 10, the processor configured optimize the computable non-linear function by generating a set of one or more parameters for the computable non-linear function, the computable non-linear function is a function that can be approximated by a function including at least one term that is proportional to $x^n$ where n is not equal to unity.

12. The apparatus of claim 11, the processor configured generate the optimized set of one or more parameters by iteratively applying intermediate pre-distorted electrical excitation signals to a device representative of the receiver until distortion at an output of the device representative of the receiver is reduced to a specified level, during each iteration, the processor configured to generate each intermediate pre-distorted electrical excitation signal by applying the electrical input signal (x) to the computable non-linear function with a corresponding intermediate set of one or more parameters.

13. The apparatus of claim 12, the processor configured to optimize the set of one or more parameters using a gradient descent algorithm.

14. The apparatus of claim 12, for each iteration, a processor configured to determine the distortion at the output of the device representative of the receiver before determining a new intermediate set of one or more parameters.

15. The apparatus of claim 12, the device representative of the receiver is an actual receiver, an amplifier having an input coupled to an output of the processor, wherein the amplifier applies the intermediate pre-distorted electrical excitation signals to the actual receiver when an output of the amplifier is coupled to an input of the receiver.

16. The apparatus of claim 15, the amplifier is a current amplifier.

17. The apparatus of claim 12, the device representative of the receiver is a numerically implemented model of the receiver implemented by the processor, the processor configured to implement a virtual amplifier and to apply the intermediate pre-distorted electrical excitation signals to the numerically implemented model of the receiver using the virtual amplifier.

18. The apparatus of claim 11, the computable non-linear function is a rational polynomial.

19. The apparatus of claim 11, the computable non-linear function is a hyperbolic trigonometric function approximated by a polynomial function.

20. The apparatus of claim 10, the computable non-linear function is a function that can be approximated by a function including at least one term that is proportional to where n is not equal to unity.

* * * * *